US005511872A

United States Patent [19]

Clemmensen

[11] Patent Number: 5,511,872

[45] Date of Patent: Apr. 30, 1996

[54] BUILDING SYSTEM FOR MOVABLES

[75] Inventor: Palle Clemmensen, Beder, Denmark

[73] Assignee: Byrum A/S, Skive, Denmark

[21] Appl. No.: 222,745

[22] Filed: Mar. 31, 1994

[30] Foreign Application Priority Data

Apr. 5, 1993 [DK] Denmark ..... 93 00191

[51] Int. Cl.[6] ..... A47B 77/06

[52] U.S. Cl. ..... 312/107; 312/108; 312/111; 312/198

[58] Field of Search ..... 312/107, 108, 312/111, 198

[56] References Cited

U.S. PATENT DOCUMENTS

| | | | |
|---|---|---|---|
| 2,965,428 | 12/1960 | Jacobs et al. | 312/107 X |
| 3,746,416 | 7/1973 | Sasnett et al. | 312/111 X |
| 3,746,417 | 7/1973 | Sasnett | 312/108 X |
| 3,899,228 | 8/1975 | Schruber | 312/198 X |
| 3,926,486 | 12/1975 | Sasnett | 312/198 |
| 3,971,605 | 7/1976 | Sasnett | 312/198 |
| 4,201,428 | 5/1980 | Johnson | 312/108 X |
| 4,586,759 | 5/1986 | Wrobel | 312/198 |
| 5,086,593 | 2/1992 | Walentine | 312/107 X |
| 5,199,775 | 4/1993 | Morgan et al. | 312/111 X |

*Primary Examiner*—Jose V. Chen
*Assistant Examiner*—Rodney B. White
*Attorney, Agent, or Firm*—Watson, Cole, Grindle & Watson

[57] ABSTRACT

A bulding system for building movables formed one or more individual parts and modules. The module system is constructed on a frame (1) formed of four profiles (2, 3, 4, 5) which are joined in order to form a rectangle (7). Mounted on the frame are supporting rails (8) in which base cabinets (9) may be hung and table tops (10) may be mounted. By means of further devices which interact with the frame, it is possible to extend the system to provide top cabinets. Furthermore, the system may be equipped with technical installations and other utilities for use in connection with the work at the system, and the system may be equipped with covering, side and base panels.

16 Claims, 64 Drawing Sheets

BUILDING SYSTEM FOR MOVABLES

BACKGROUND OF THE INVENTION

The present invention relates to a building system for building movables consisting of individual parts which may be mutually combined and joined comprising table tops, cabinet modules, drawer modules, front panels, rear panels, side panels, base panels, carrying frames, and supporting legs, cable trays, piping channels, bracing crosses and other movable elements and modules.

In relation systems of furniture, particularly for use in workshops or laboratories, there is a need for the system to be adaptable very individually, not only to the individual company but also to the individual employee.

Companies will often require that such systems permit access to certain installations and facilities. There may be requirements for installations such as electricity, gas, water, compressed air or some other kind of utility. There may further be requirements for special facilities such as writing desks, modules for computer equipment or for measuring equipment. In addition, there will often also be a need for a certain number of cabinets and drawers, either below or above table height, and a need for special table tops with wash basins or the like.

All these individual requirements mean that it is difficult to integrate singular, separate and independent movable elements into a whole constituting a system. Such singular and independent movable elements will not sufficiently meet the requirements and wishes of the company or the staff in relation to variation and enlargement options.

SUMMARY OF THE INVENTION

Thus, it is the object of the present invention to provide a system which is constructed on one basic element which forms the core of the system and in which the individual movable and module parts and other installations are mutually planned and integrated around the basic element.

This is achieved by a system which is characterized in that the system also comprises frames consisting of at least four profiles which are mutually joined in pairs in a right angle, the frames being intended for being placed on or secured to a supporting surface and comprising devices for securing the movable parts and modules.

With a frame as the carrying element in a system of the type in which the individual movable or installation elements are secured to the frame, the degrees of freedom for individual adaption to the requirements and wishes of a company or an employee are considerably increased. The frame may be mounted initially and subsequently it is possible to secure the other individual elements according to need, requirements and wishes. If these requirements, wishes and needs change later on, it is possible to amend the planning of individual movable parts without having to move the frame.

By letting the frame consist of a substantially rectangular frame, one obtains an element with high torsional stability and able to carry even heavy loads, e.g., in the form of base cabinets or the like. The frame element may have many different sizes depending on whether it is intended to be placed on or secured to a floor, whether it is intended to be secured to a wall, and whether it is intended only for base cabinets or for a combination of base and top cabinets.

BRIEF DESCRIPTION OF THE INVENTION

The invention will now be described in further detail with reference to the attached drawing, in which.

DETAILED DESCRIPTION OF THE PREFERRED EMBODIMENTS

Figure 1:
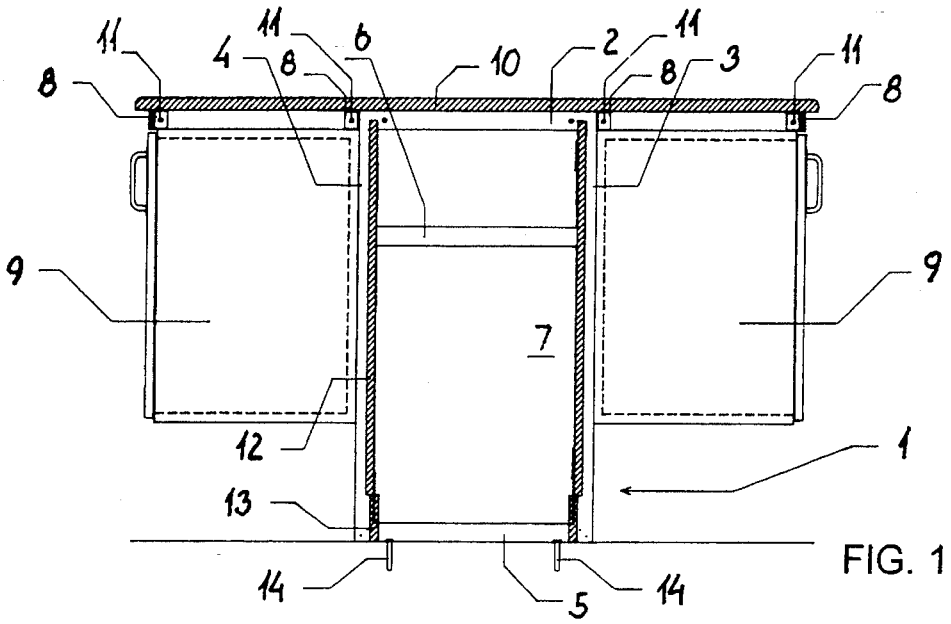
FIGS. 1–66 illustrate systems with different types of frames.
Figure 2:
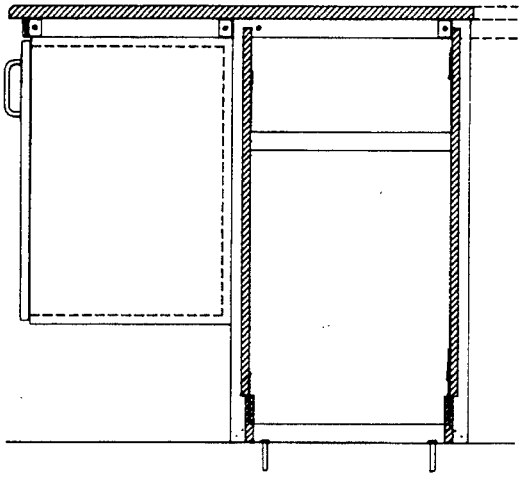
Figure 3:
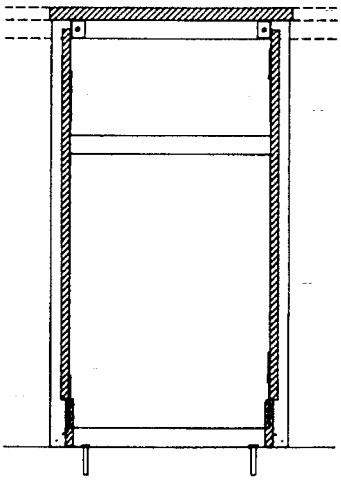
Figure 4:
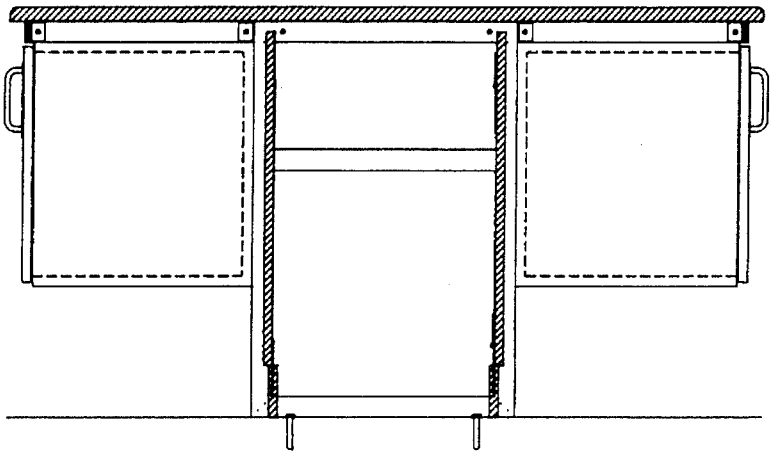
Figure 5:
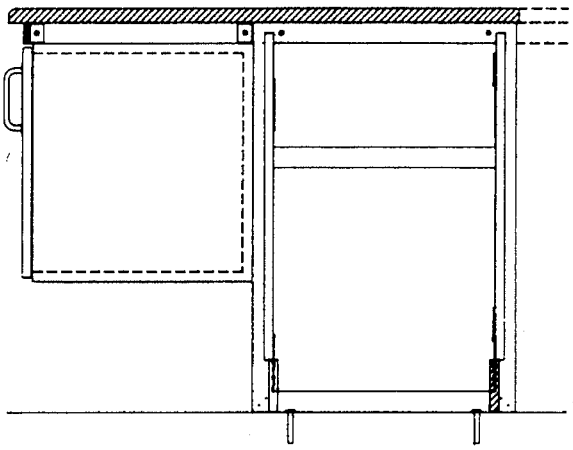
Figure 6:
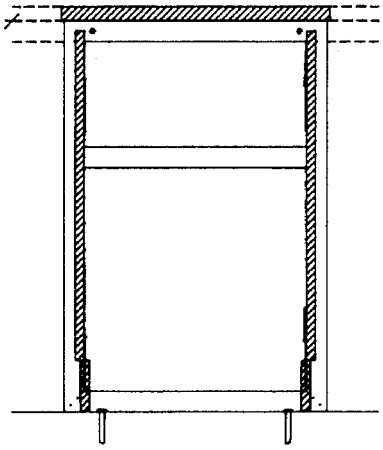
Figure 7:
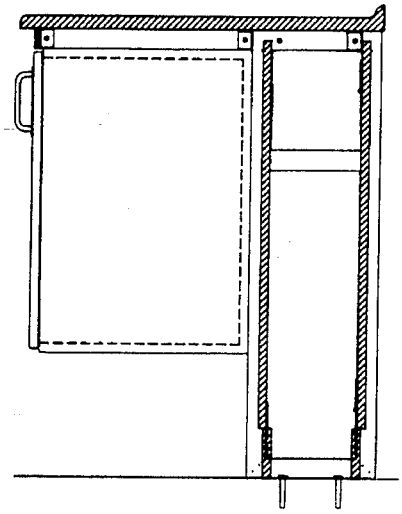
Figure 8:
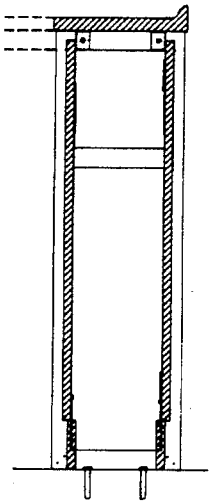

FIGS. 1–8 show different dispositions of the system according to the invention. All the systems are built on a frame 1 consisting of four profiles 2, 3, 4, 5. The profile 2 in this embodiment extends to both sides beyond the circumference of a rectangle 7 which is defined by the other profiles 3, 4, 5 and the central part of the profile 2. In the embodiments shown the frames comprise a cross brace 6. Mounted on the frame are longitudinal supporting rails on which cabinets 9 are hung and on which a table top 10 is placed. The supporting rails are secured to the frame by means of bolts 11. Furthermore, covering panels 12 and base panels 13 are mounted on the frame. The frames are of a type which is intended to be secured to the floor by means of anchor bolts 14 or otherwise.

It appears from the figures that the frames may have different sizes. The indicated measures, however, are not to be seen as limitations of the potential sizes of the frames, but merely as preferred measures for the frames. The frames in the embodiments shown consist of square steel profiles which are joined in pairs by welding. In order to reduce the risk of corrosion at the joints adjacent the floor, the profiles are joined at that position by mitre a joint.

Figure 9:
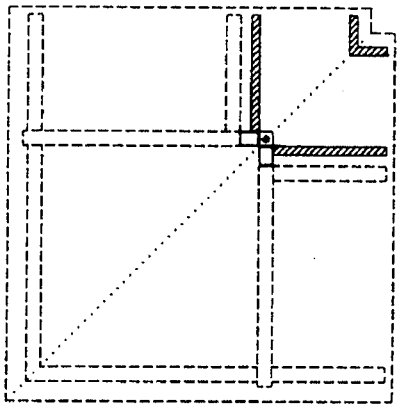
Figure 10:
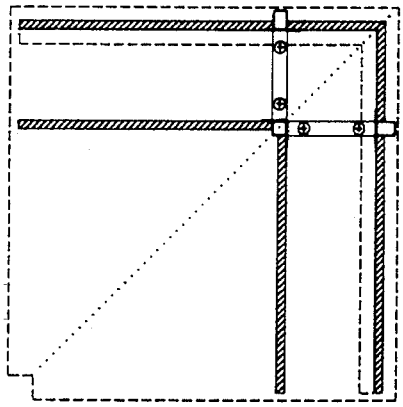
Figure 11:
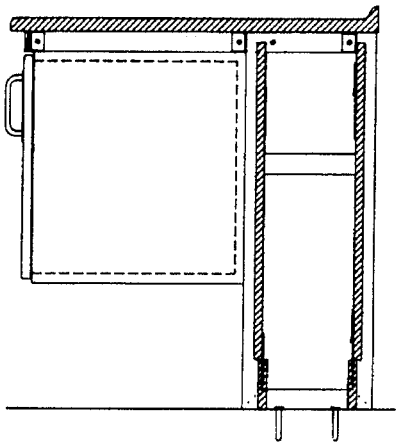
Figure 12:
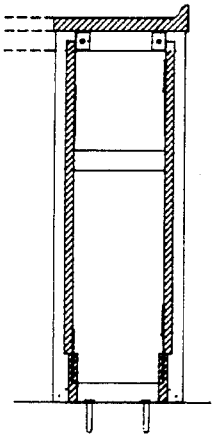
Figure 13:
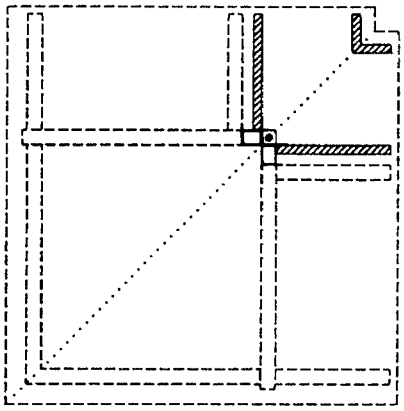
Figure 14:
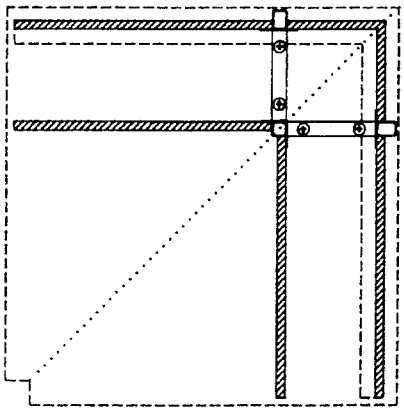
Figure 15:
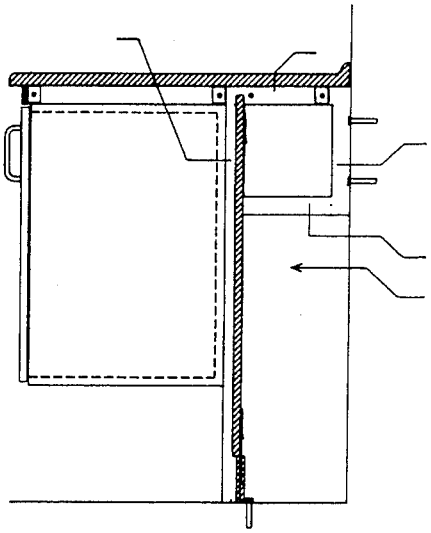
Figure 16:
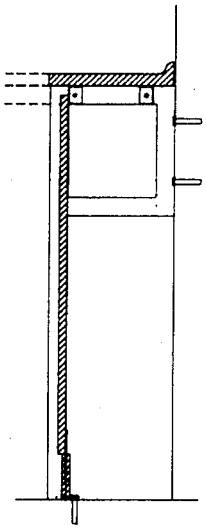
Figure 17:
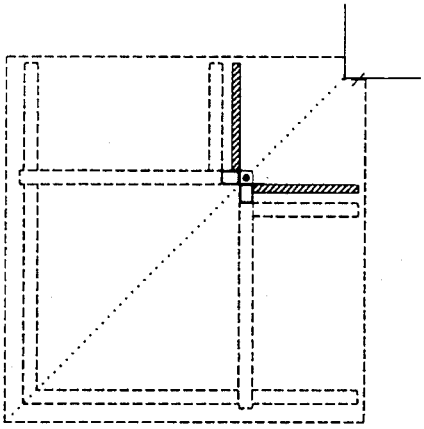
Figure 18:
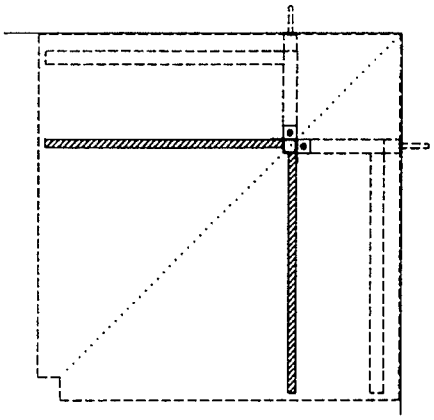
Figure 19:
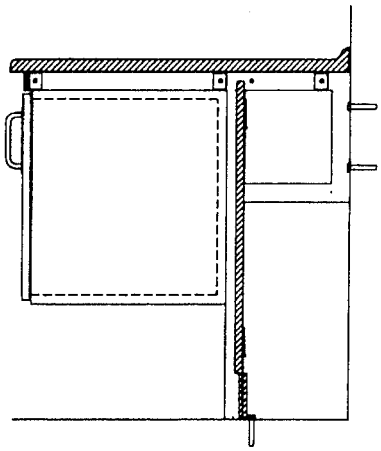
Figure 20:
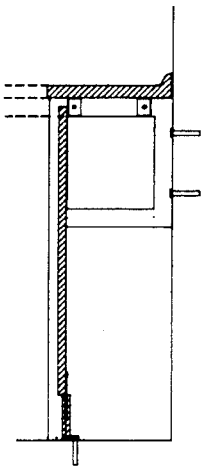
Figure 21:
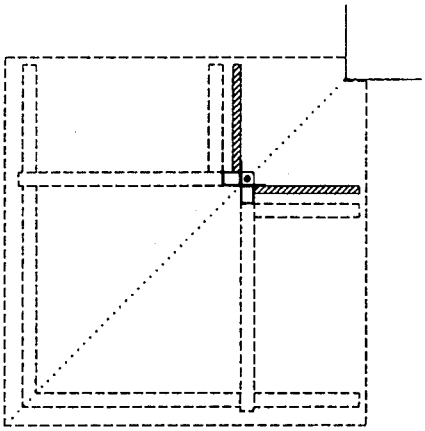
Figure 22:
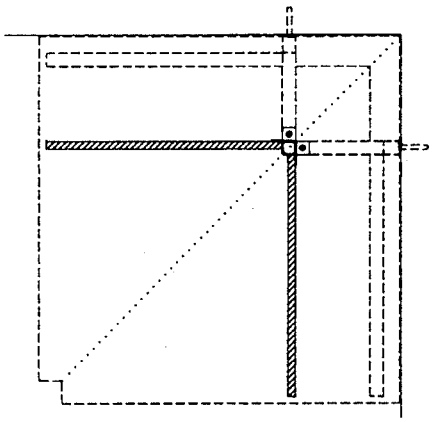
Figure 23:
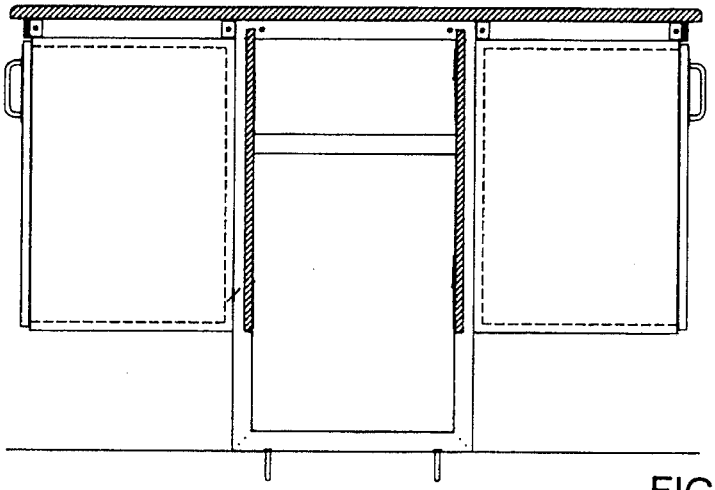
Figure 24:
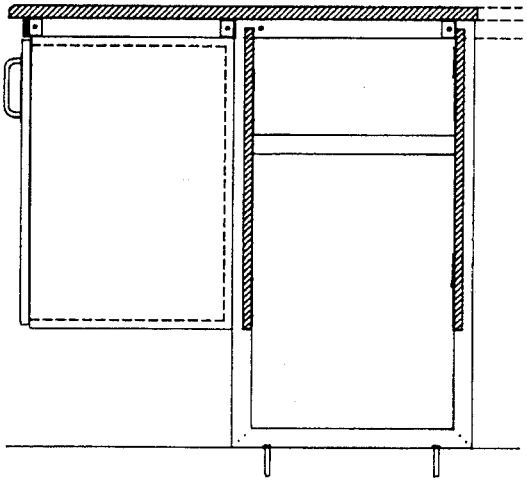
Figure 25:
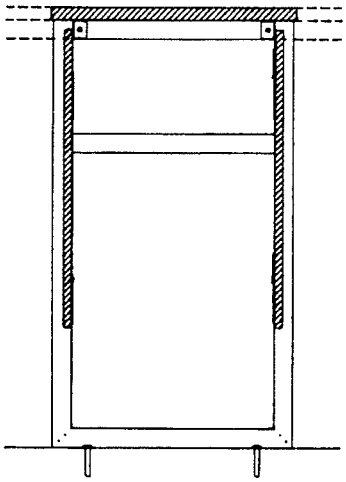
Figure 26:
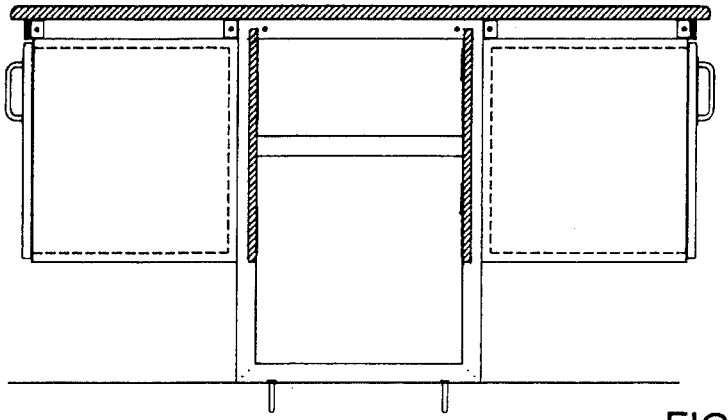
Figure 27:
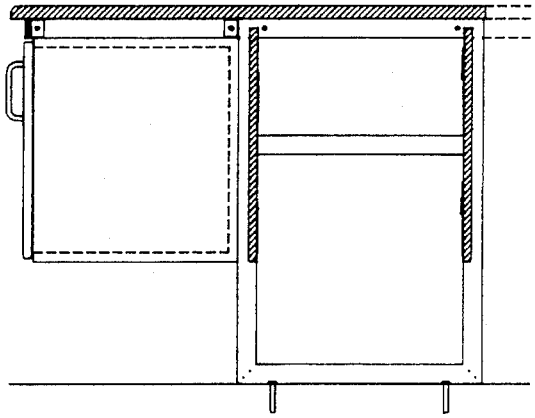
Figure 28:
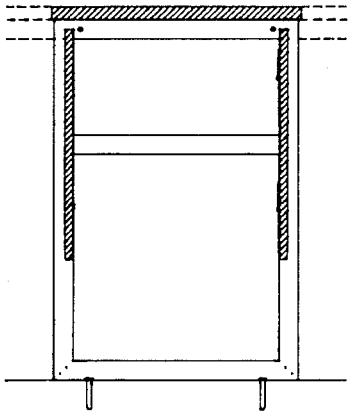
Figure 29:
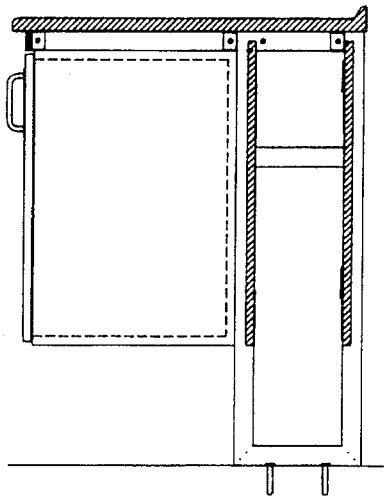
Figure 30:
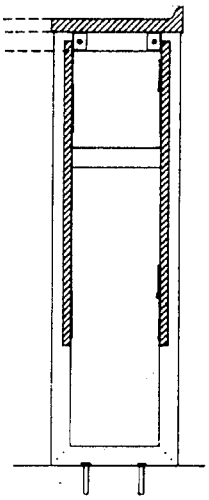
Figure 31:
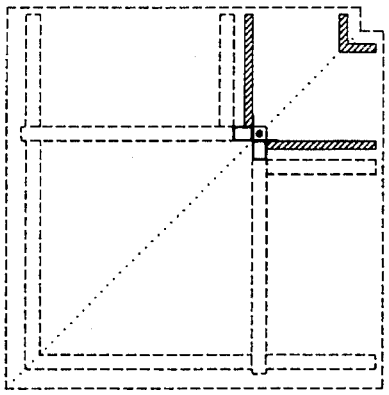
Figure 32:
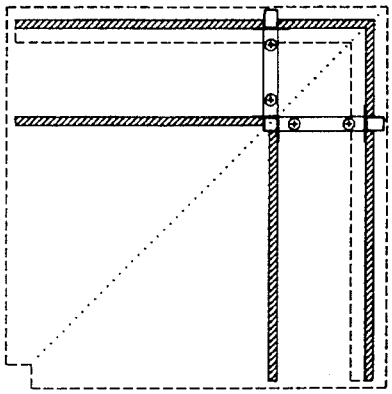
Figure 33:
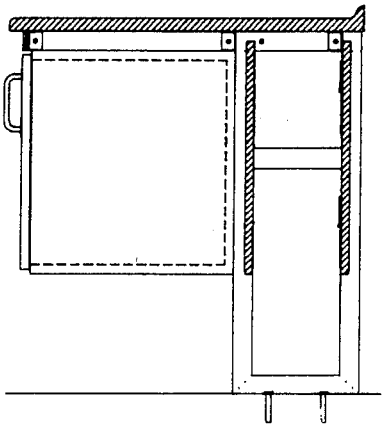
Figure 34:
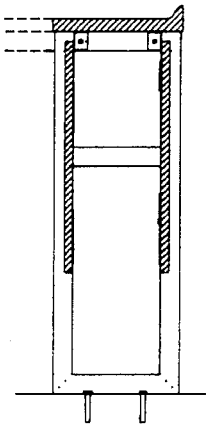
Figure 35:
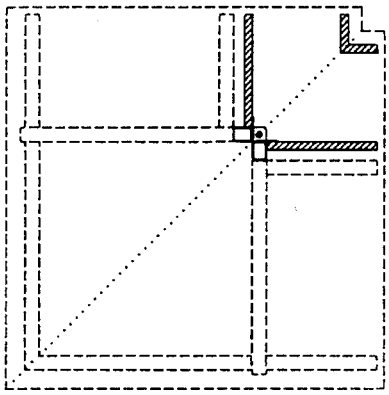
Figure 36:
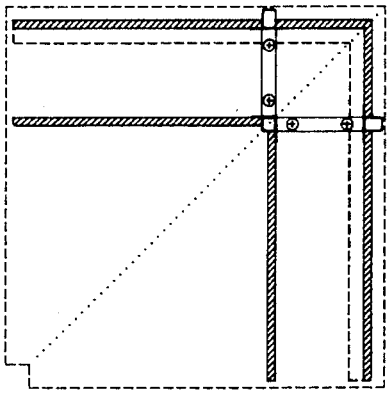
Figure 37:
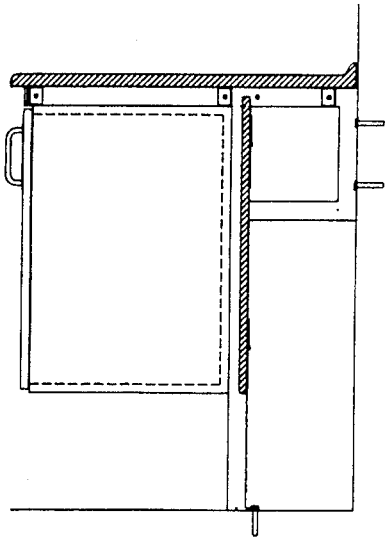
Figure 38:
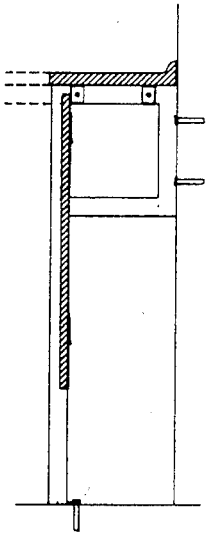
Figure 39:
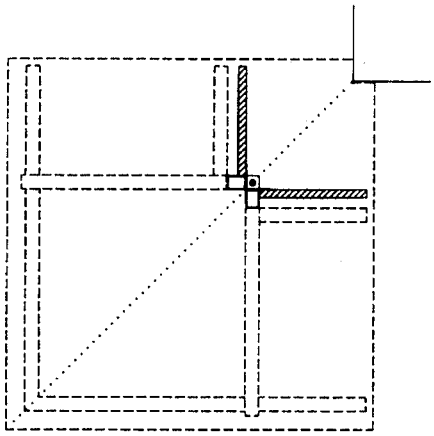
Figure 40:
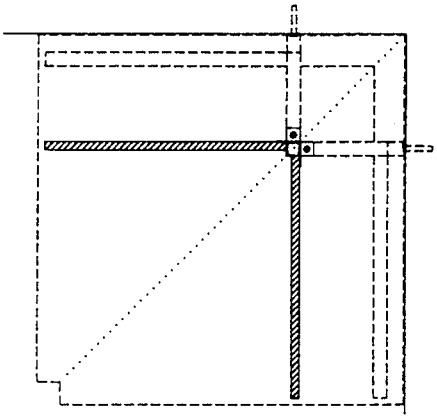
Figure 41:
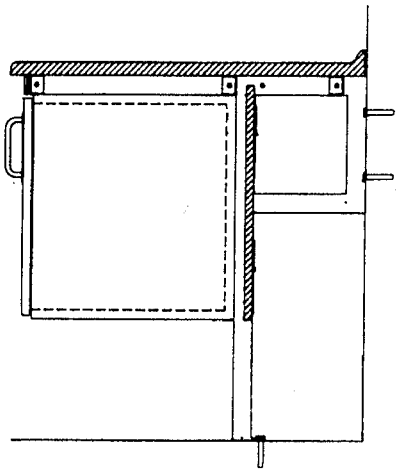
Figure 42:
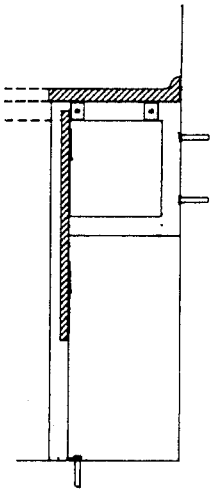
Figure 43:
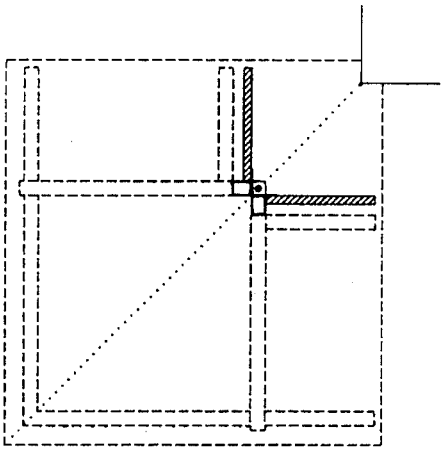
Figure 44:
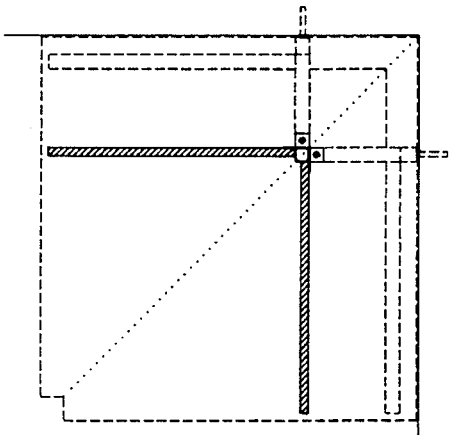
Figure 45:
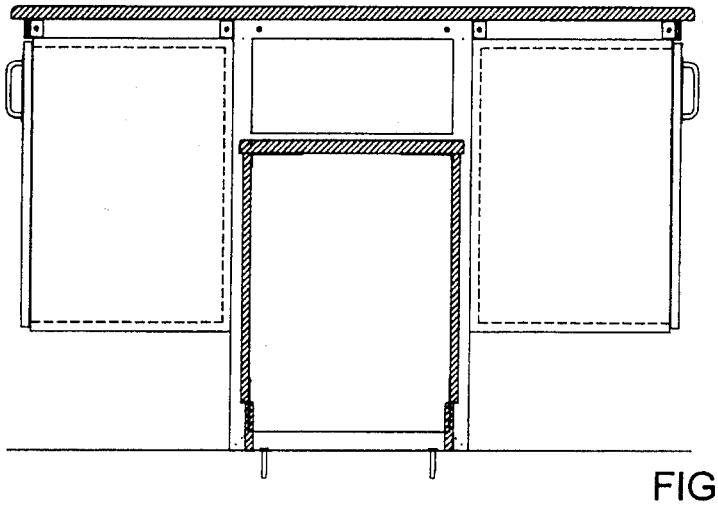
Figure 46:
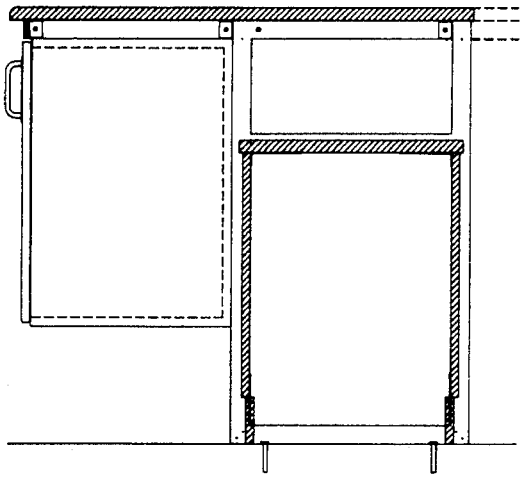
Figure 47:
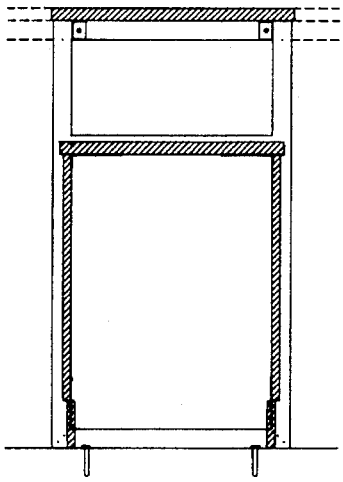
Figure 48:
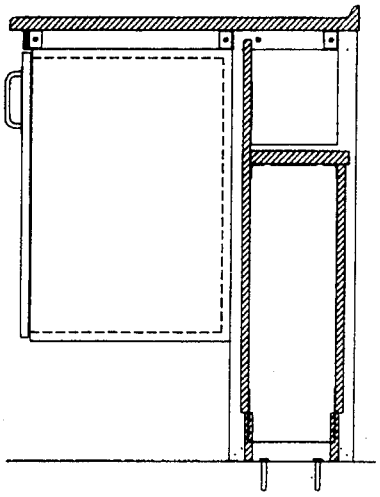
Figure 49:
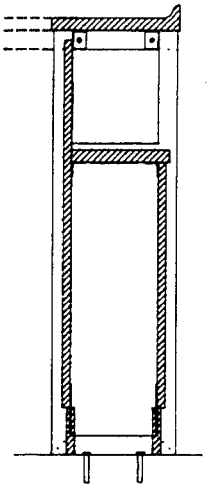
Figure 50:
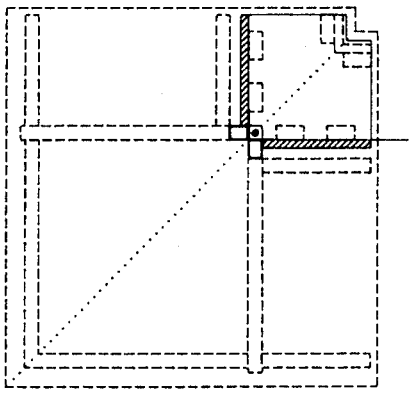
Figure 51:
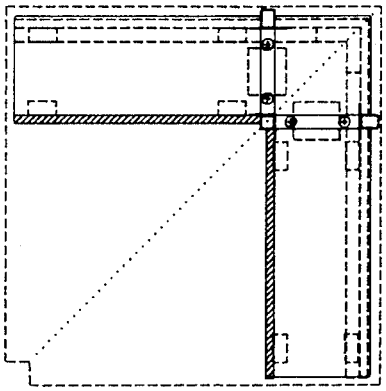
Figure 52:
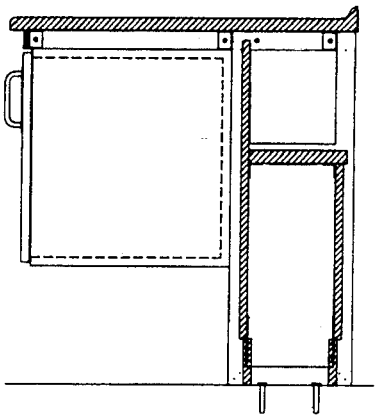
Figure 53:
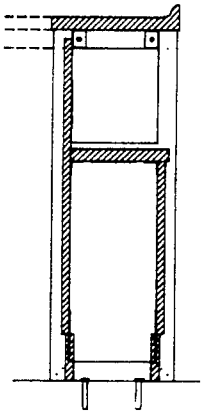
Figure 54:
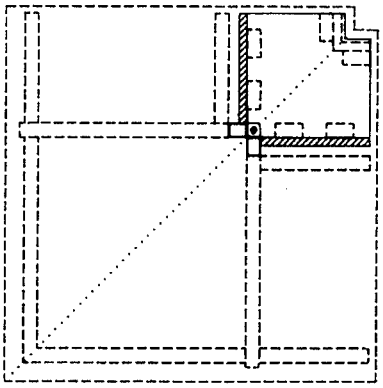
Figure 55:
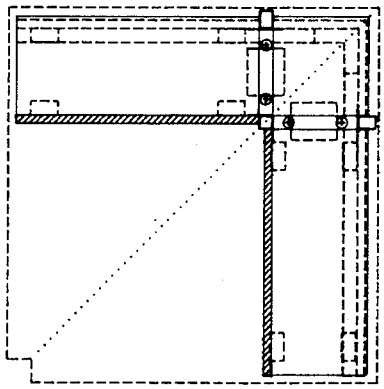
Figure 56:
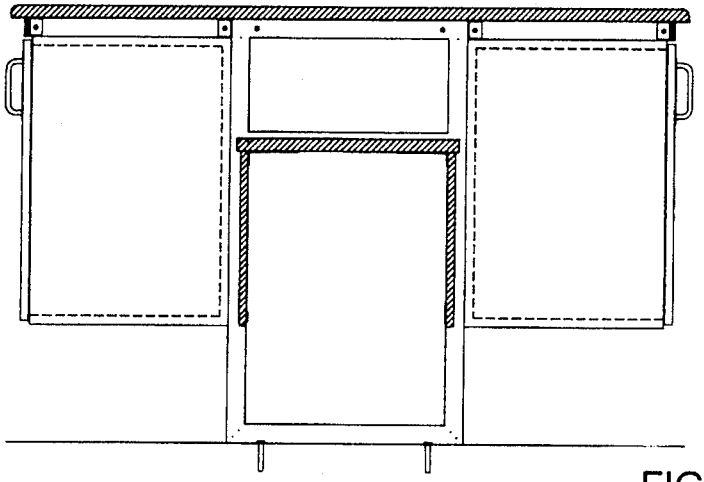
Figure 57:
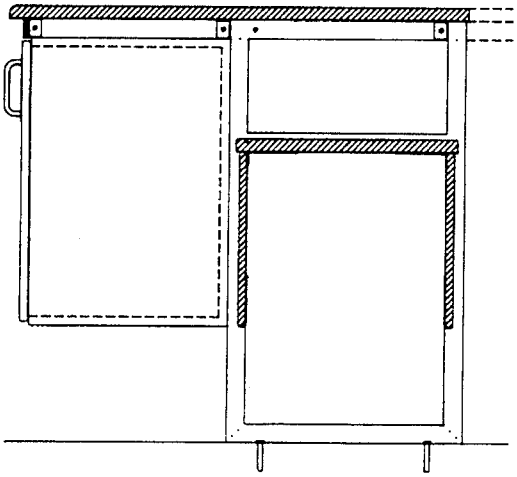
Figure 58:
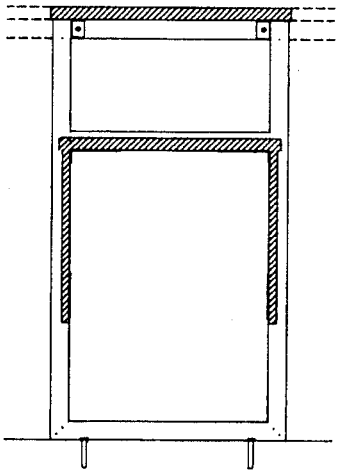
Figure 59:
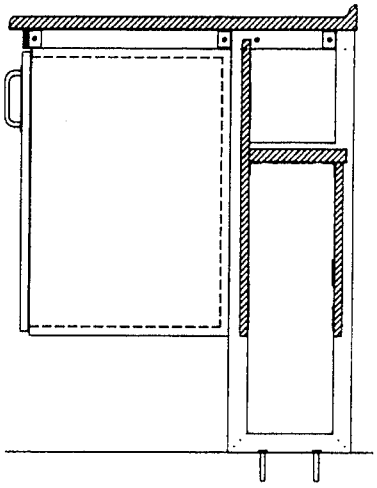
Figure 60:
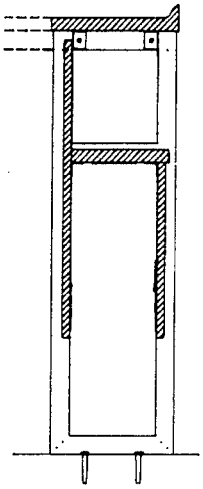
Figure 61:
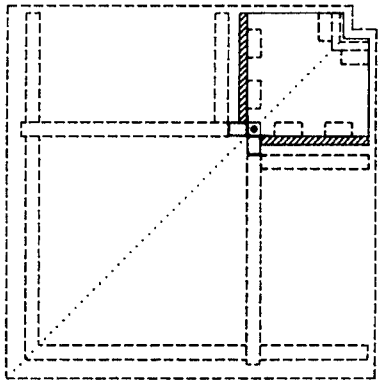
Figure 62:
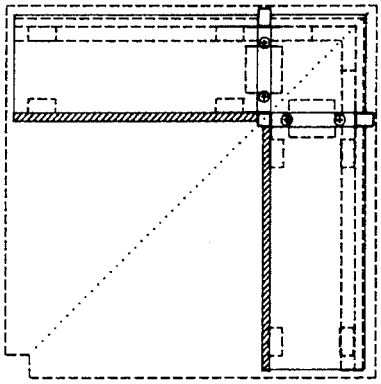
Figure 63:
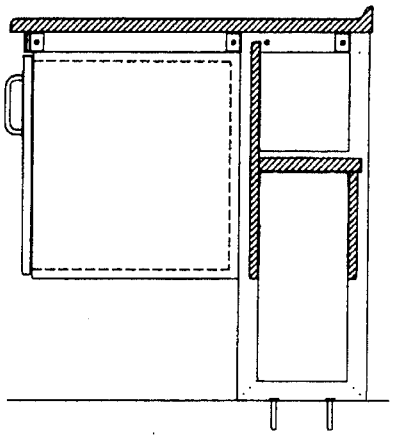
Figure 64:
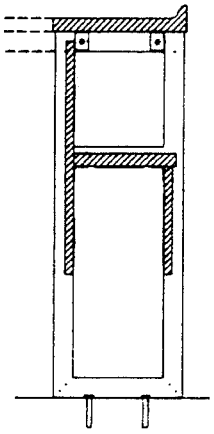
Figure 65:
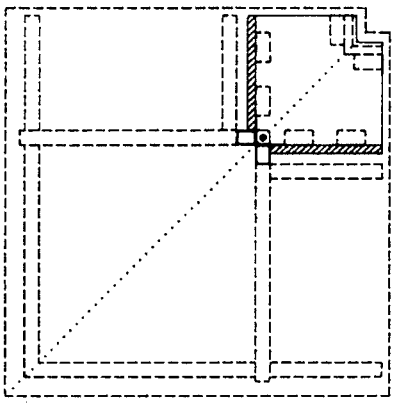
Figure 66:
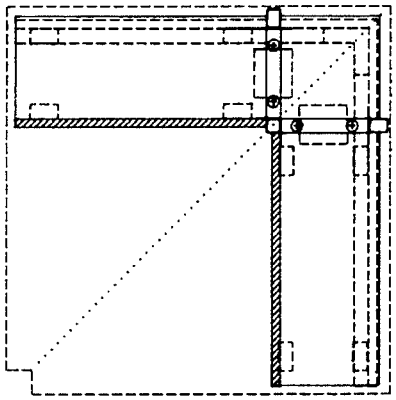
Figure 67:
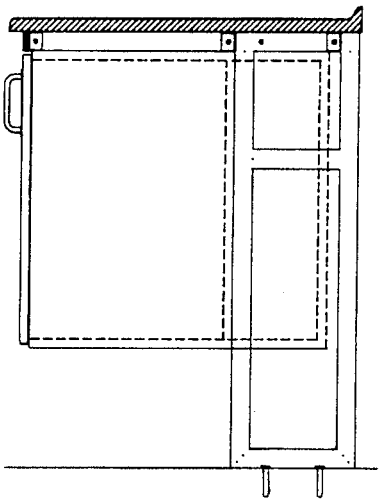
FIGS. 67–80 illustrate different types of tables.
Figure 68:
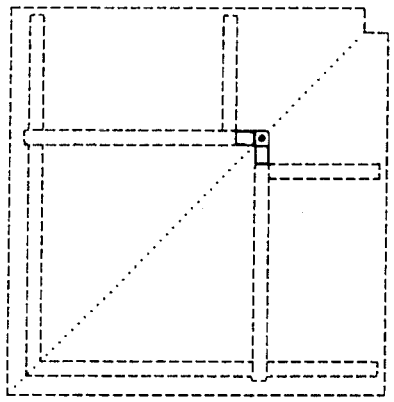
Figure 69:
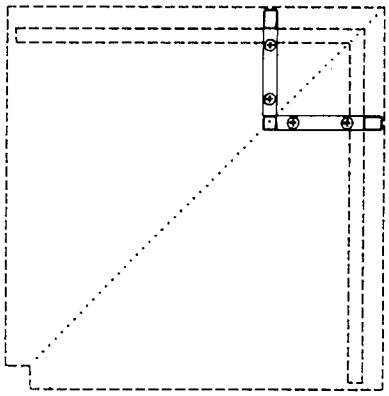
Figure 70:
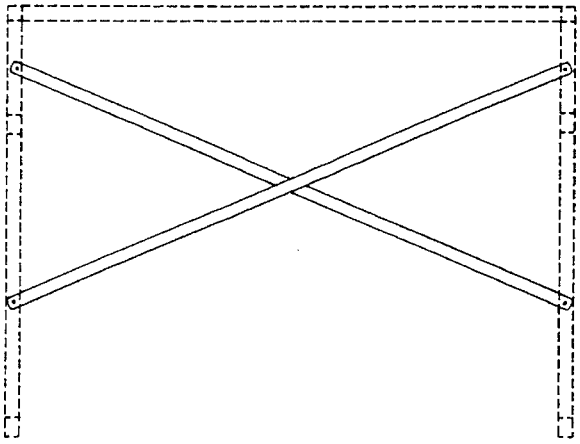
Figure 71:
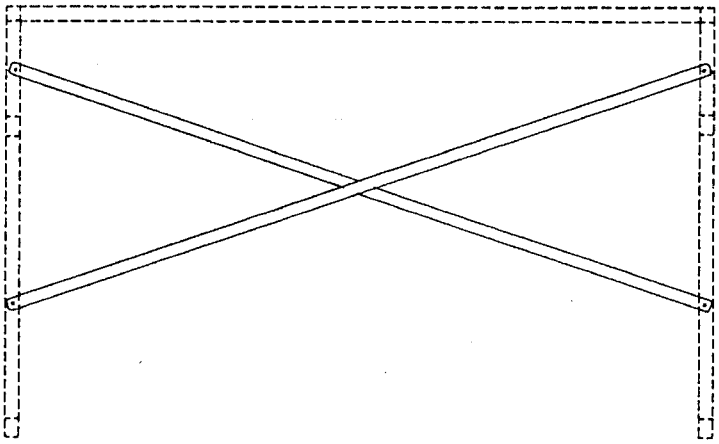
Figure 72:
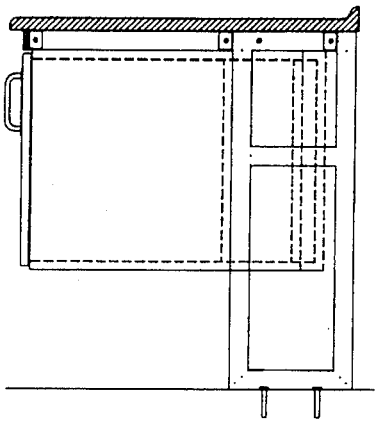
Figure 73:
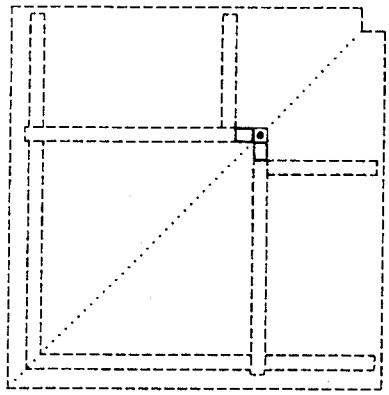
Figure 74:
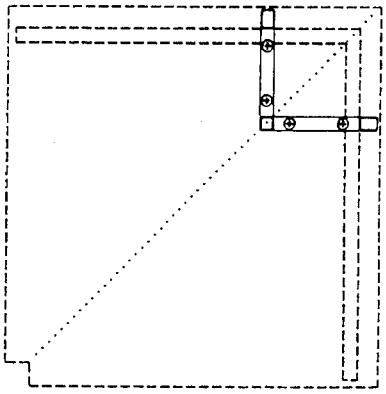
Figure 75:
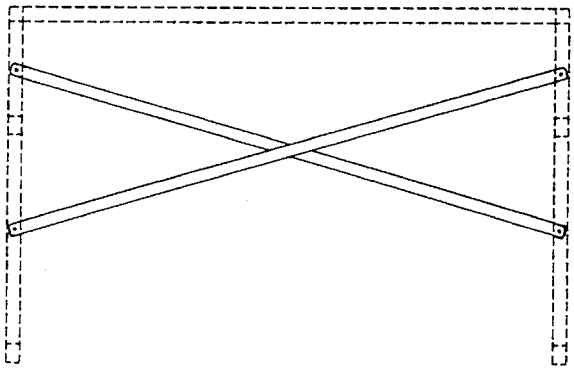
Figure 76:
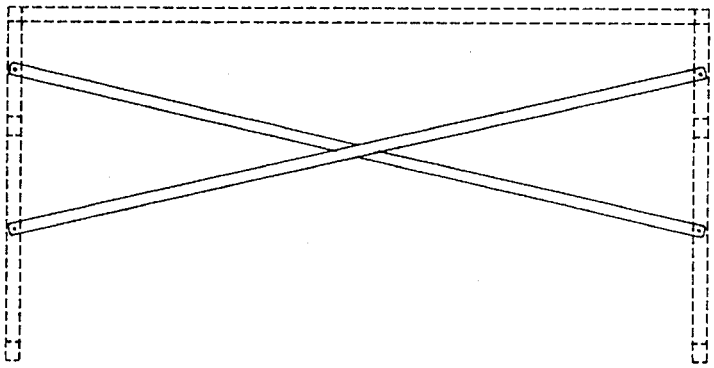
Figure 77:
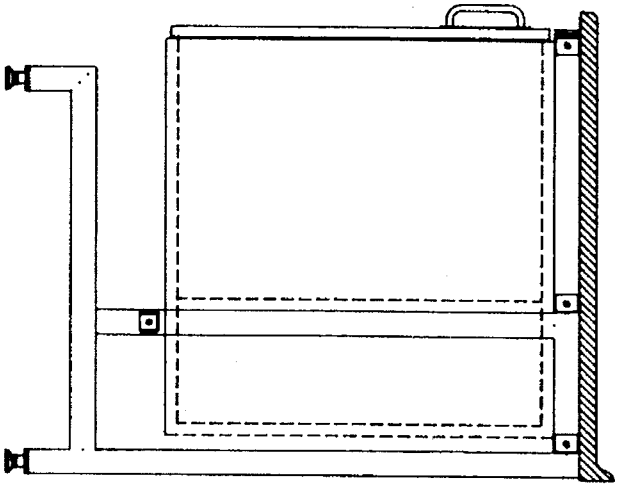
Figure 78:
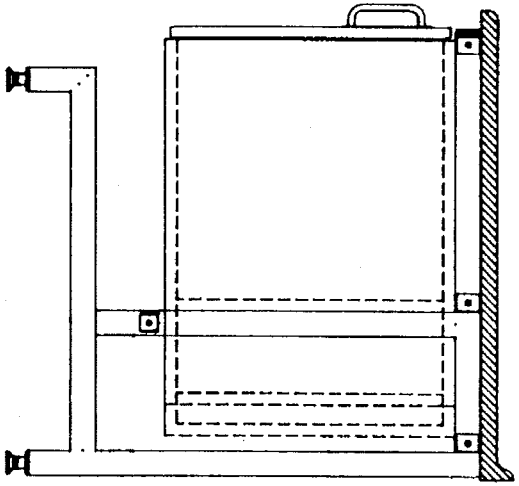
Figure 79:
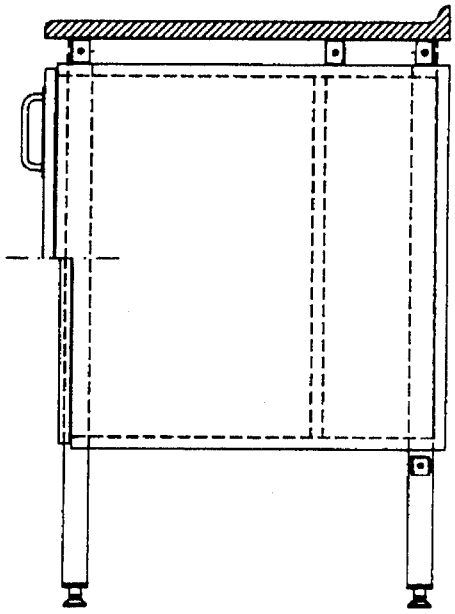
Figure 80:
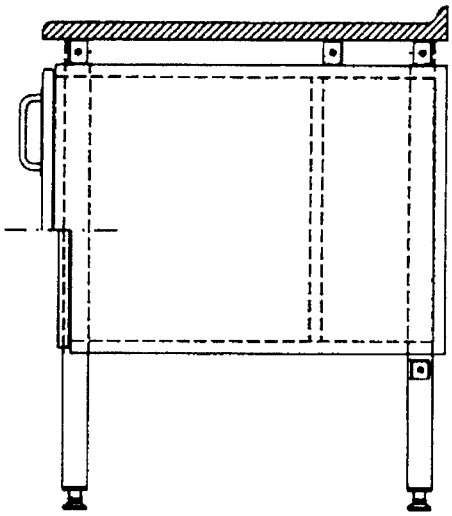
Figure 81:
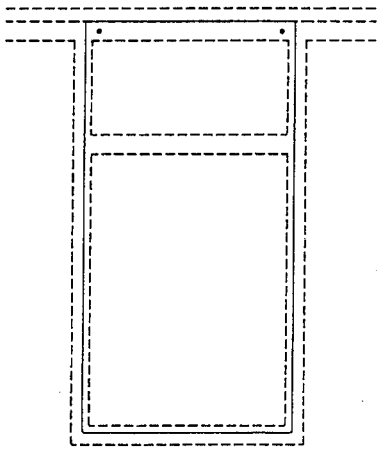
FIGS. 81–124 illustrates different types of covering panels.
Figure 82:
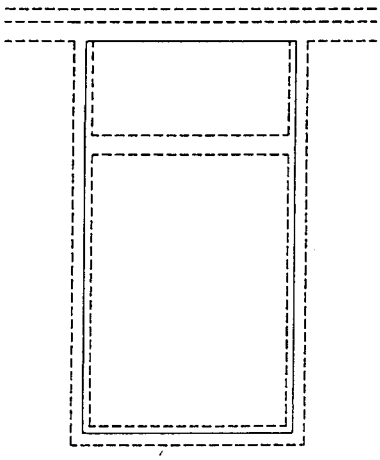
Figure 83:
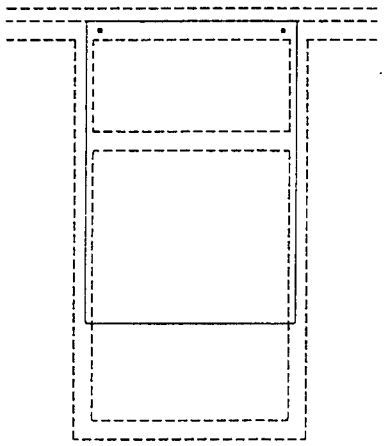
Figure 84:
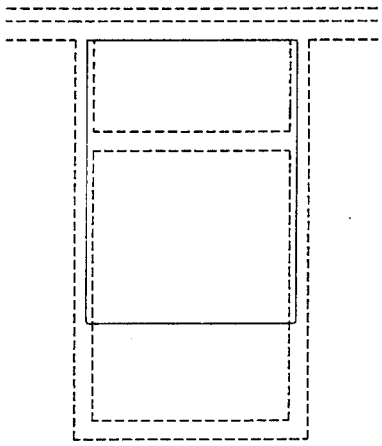
Figure 85:
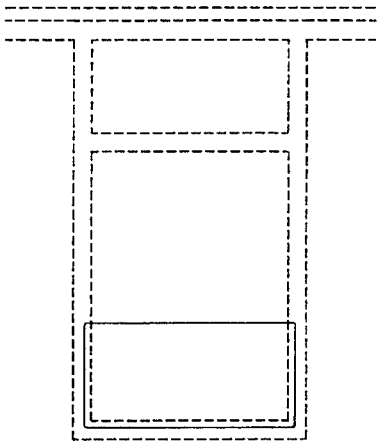
Figure 86:
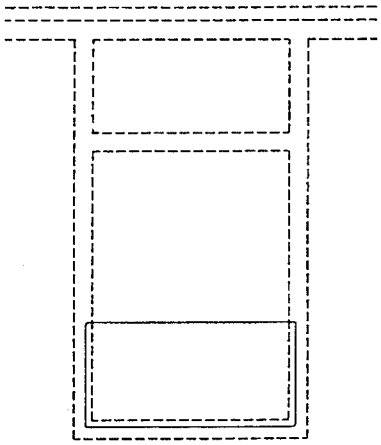
Figure 87:
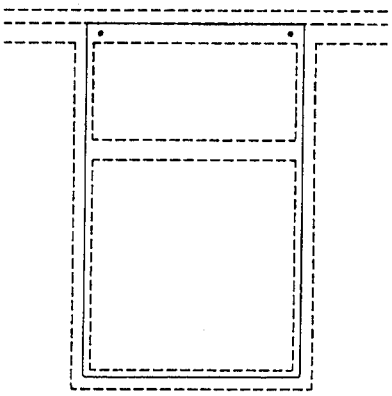
Figure 88:
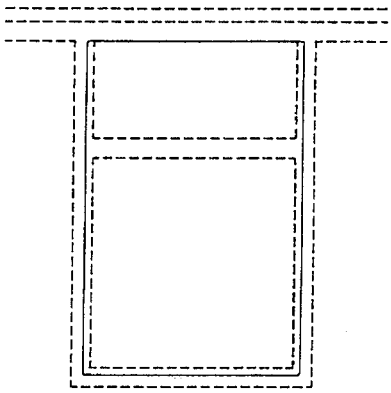
Figure 89:
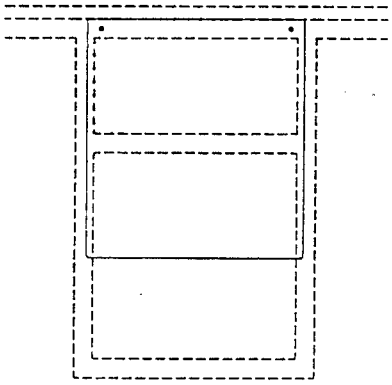
Figure 90:
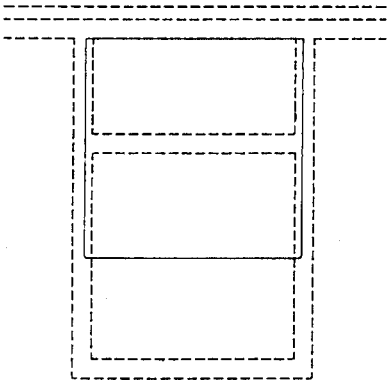
Figure 91:
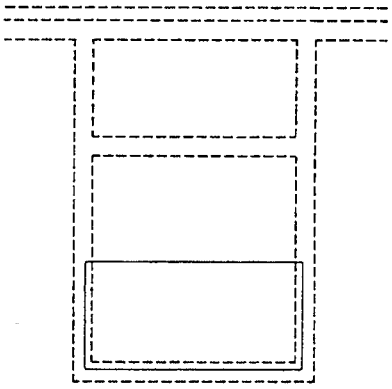
Figure 92:
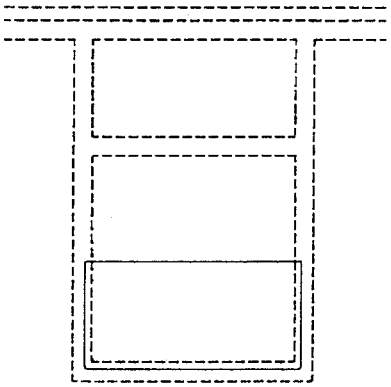
Figure 93:
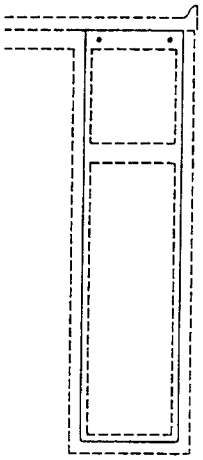
Figure 94:
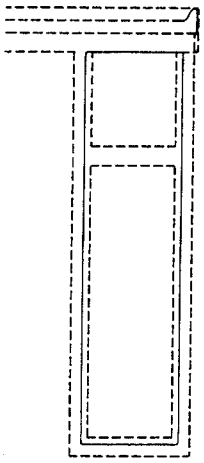
Figure 95:
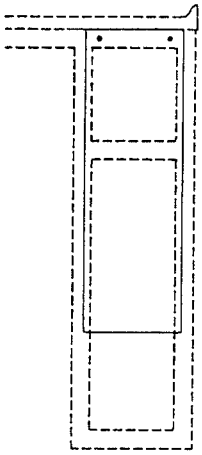
Figure 96:
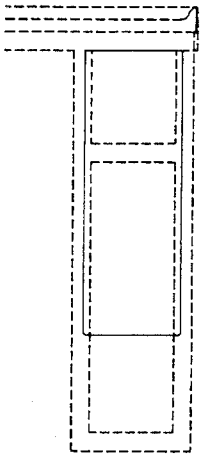
Figure 97:
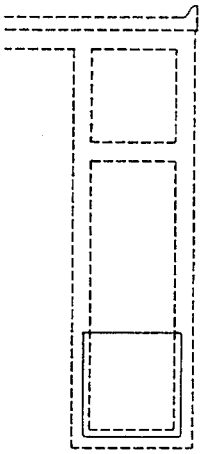
Figure 98:
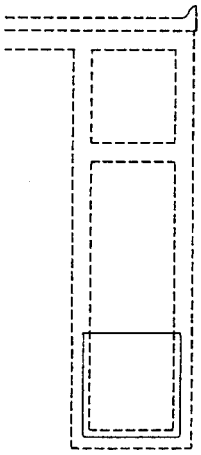
Figure 99:
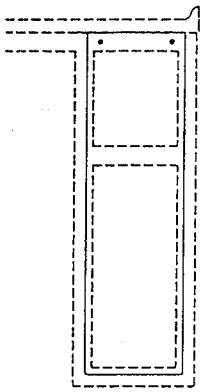
Figure 100:
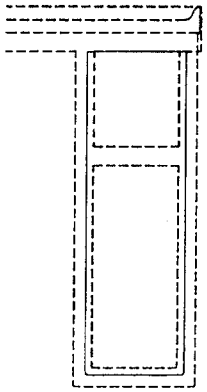
Figure 101:
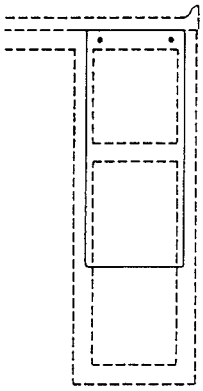
Figure 102:
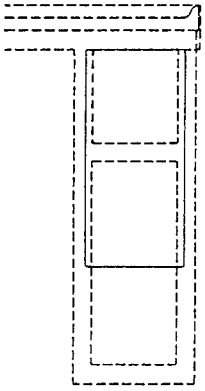
Figure 103:
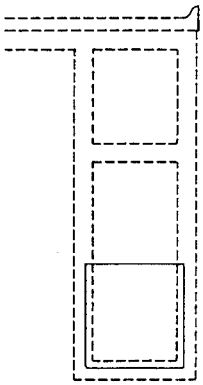
Figure 104:
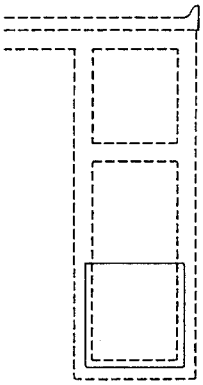
Figure 105:
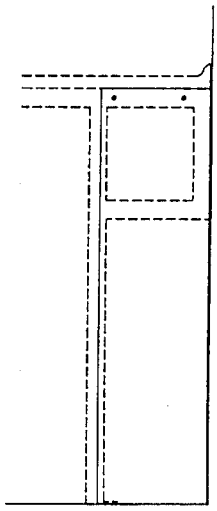
Figure 106:
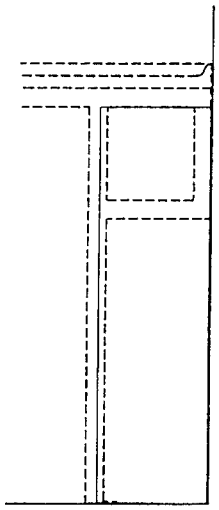
Figure 107:
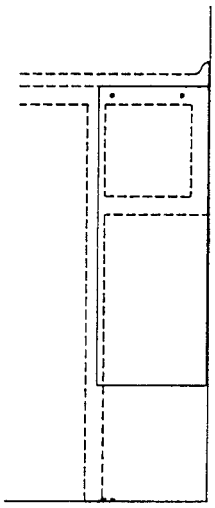
Figure 108:
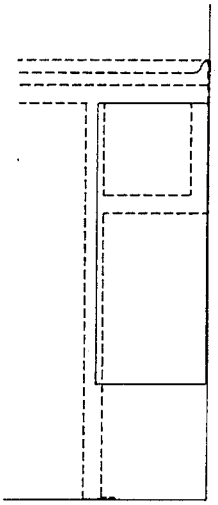
Figure 109:
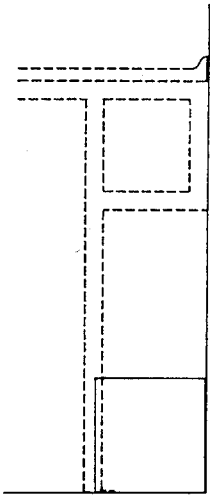
Figure 110:
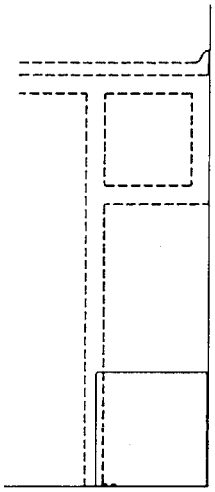
Figure 111:
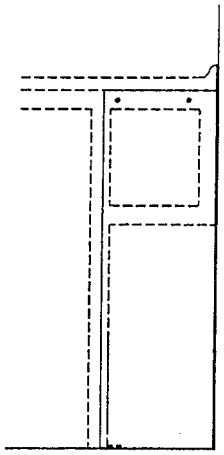
Figure 112:
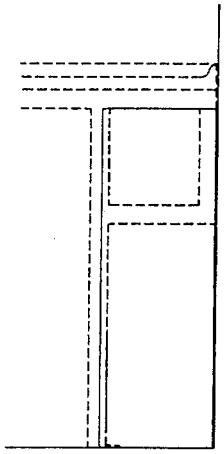
Figure 113:
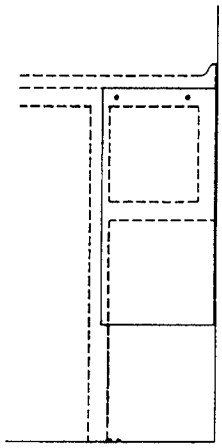
Figure 114:
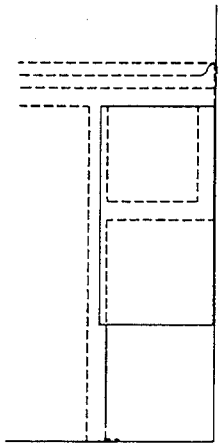
Figure 115:
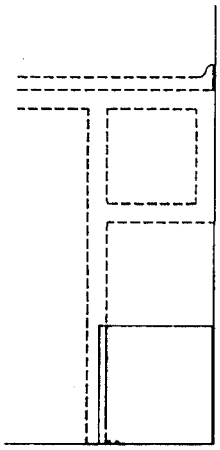
Figure 116:
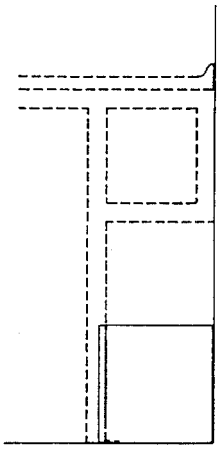
Figure 117:
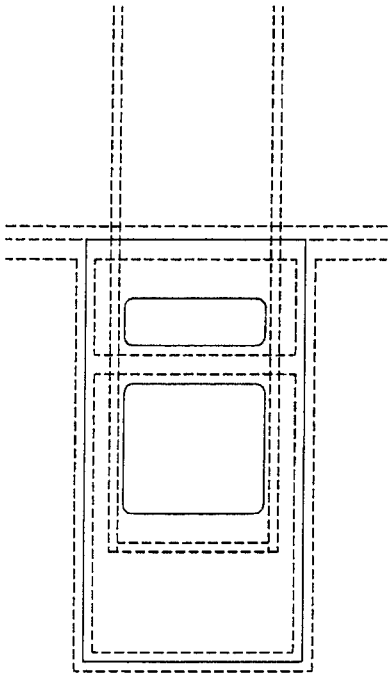
Figure 118:
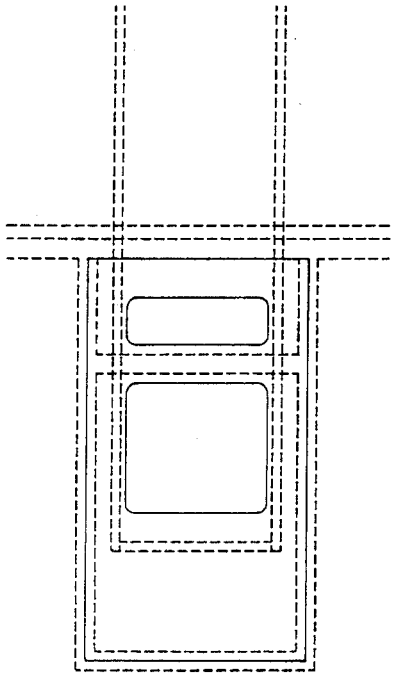
Figure 119:
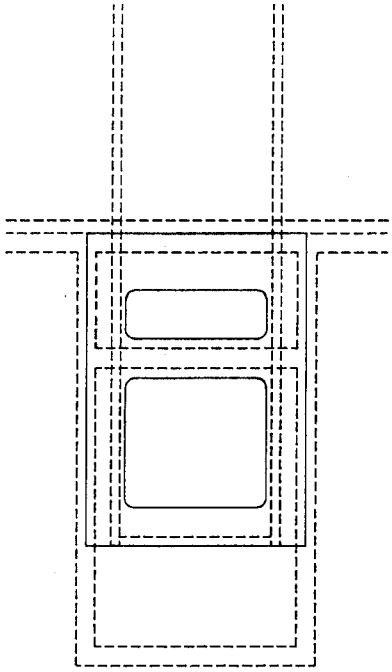
Figure 120:
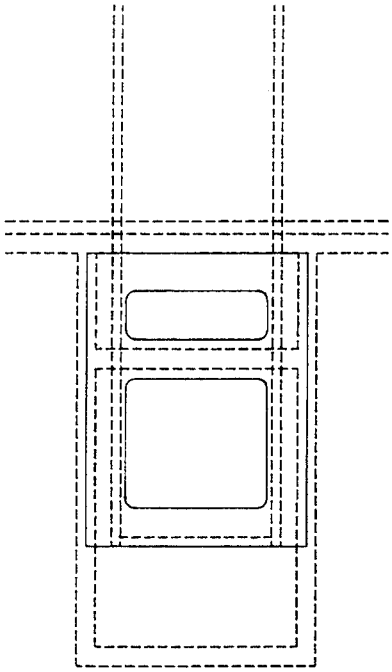
Figure 121:
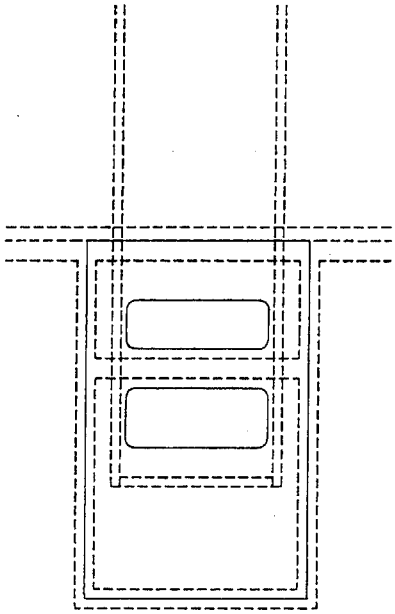
Figure 122:
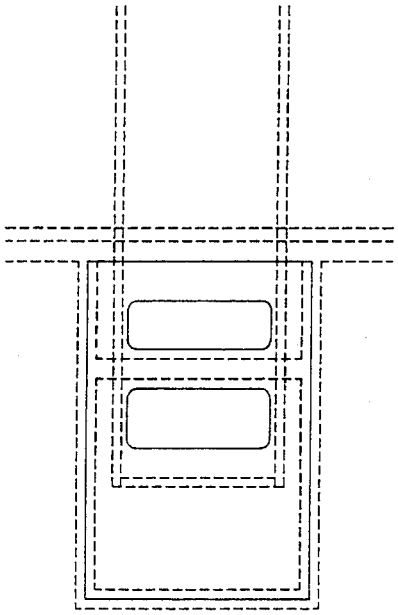
Figure 123:
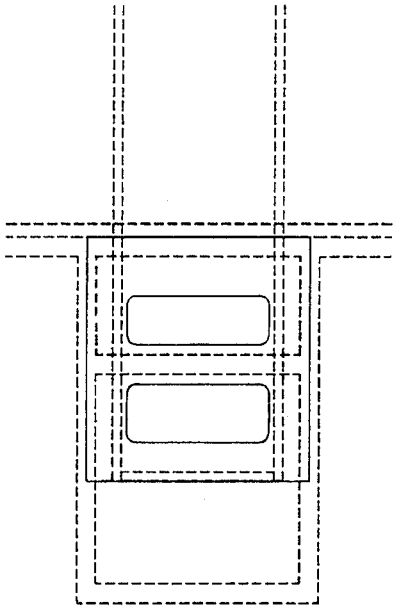
Figure 124:
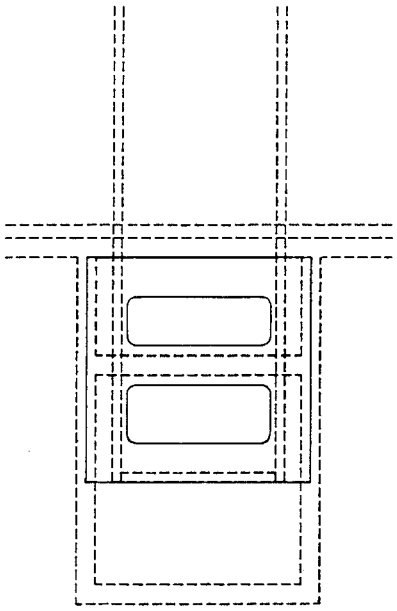
Figure 125:
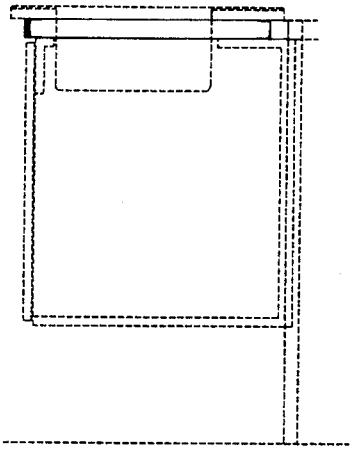
FIGS. 125–137 illustrate different bottom parts and carrying profiles.
Figure 126:
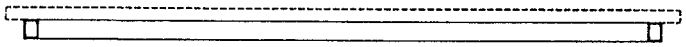
Figure 127:
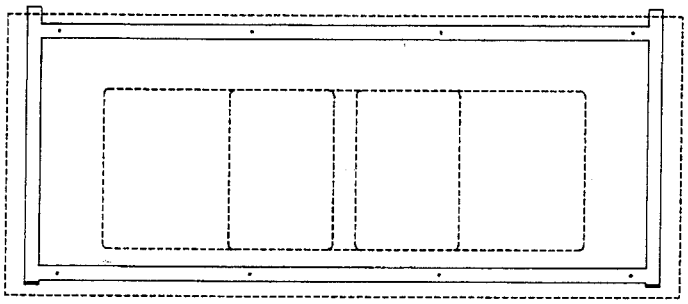
Figure 128:
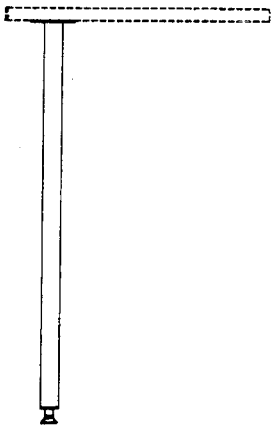
Figure 129:
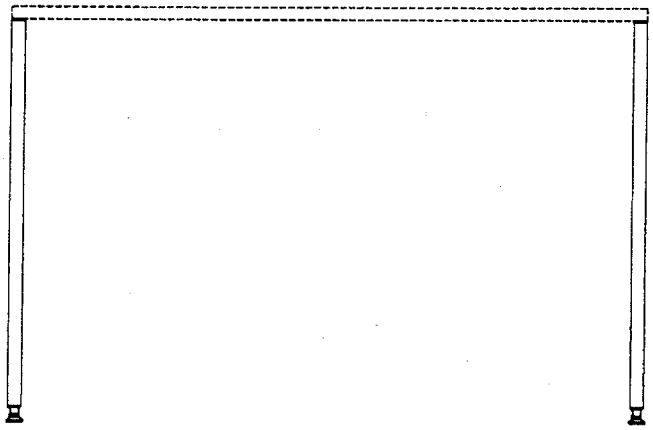
Figure 130:
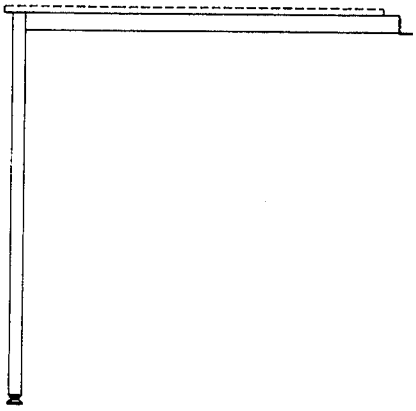
Figure 131:
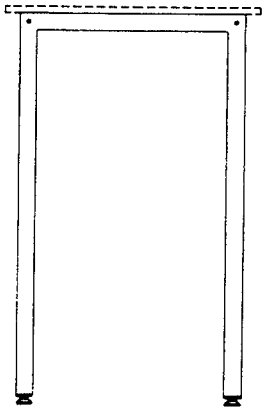
Figure 132:
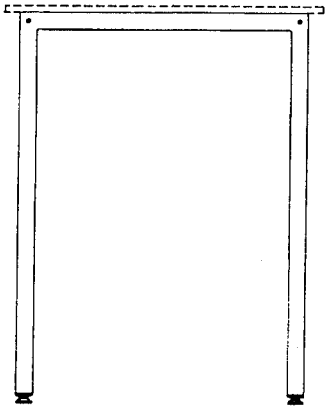
Figure 133:
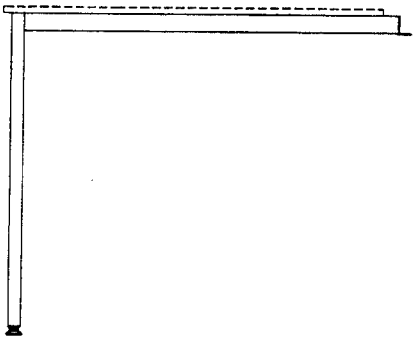
Figure 134:
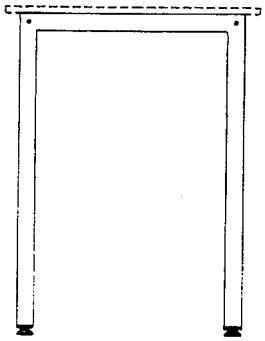
Figure 135:
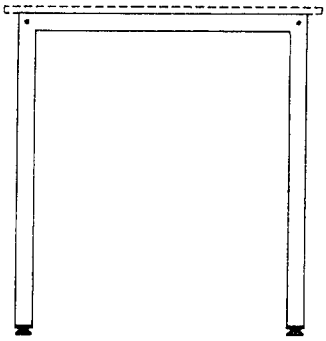
Figure 136:
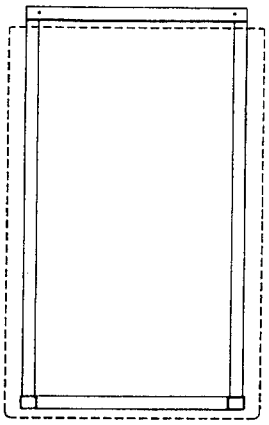
Figure 137:
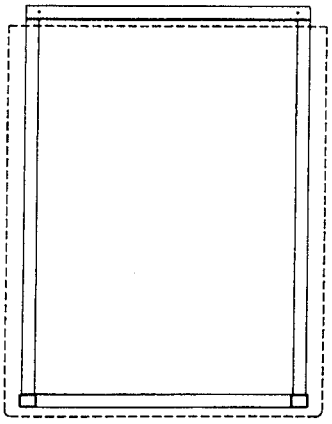
Figure 138:
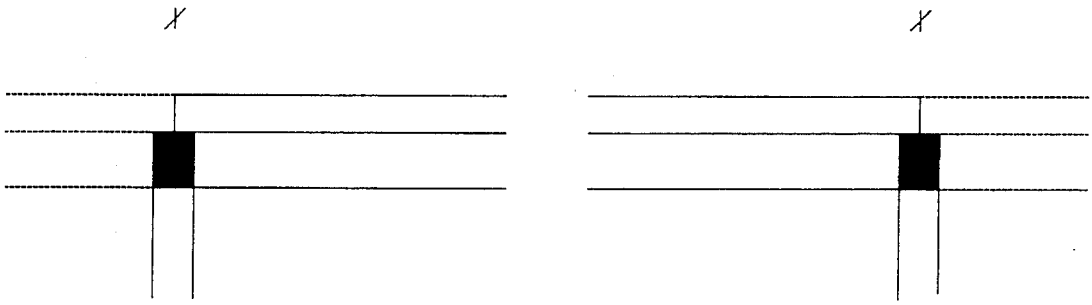
FIGS. 138–168 illustrate different types of table tops.
Figure 139:
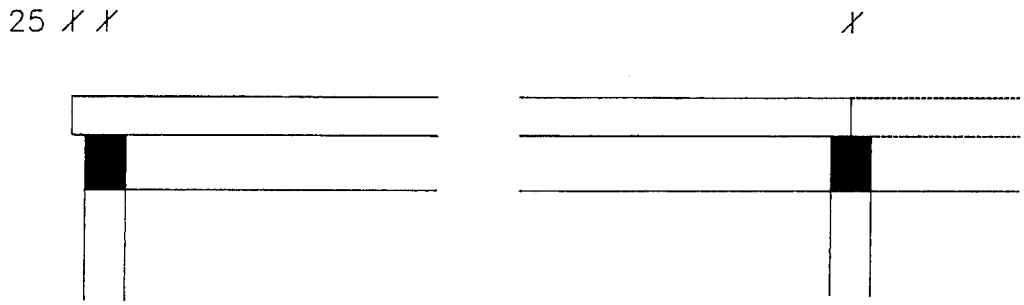
Figure 140:
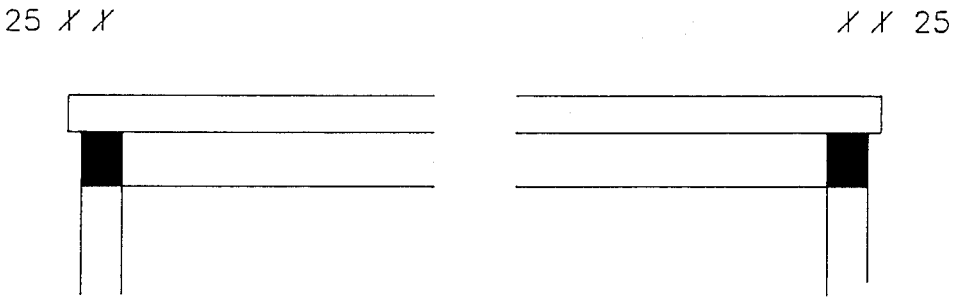
Figure 141:
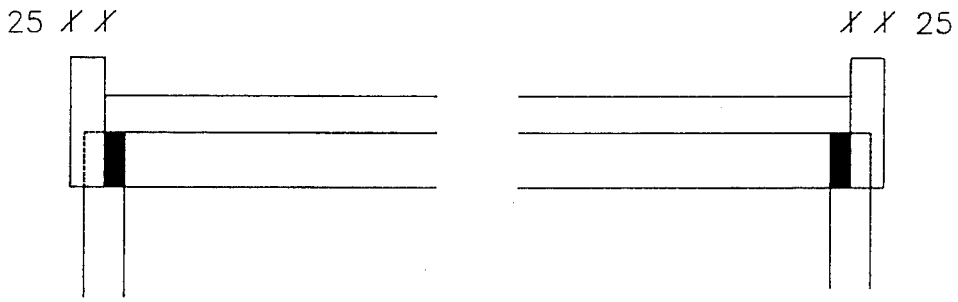
Figure 142:
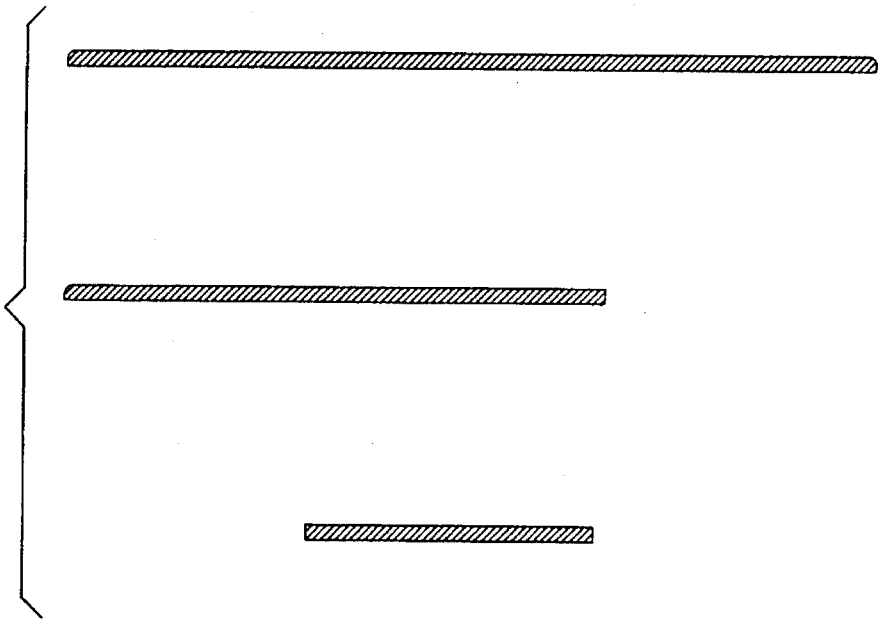
Figure 143:
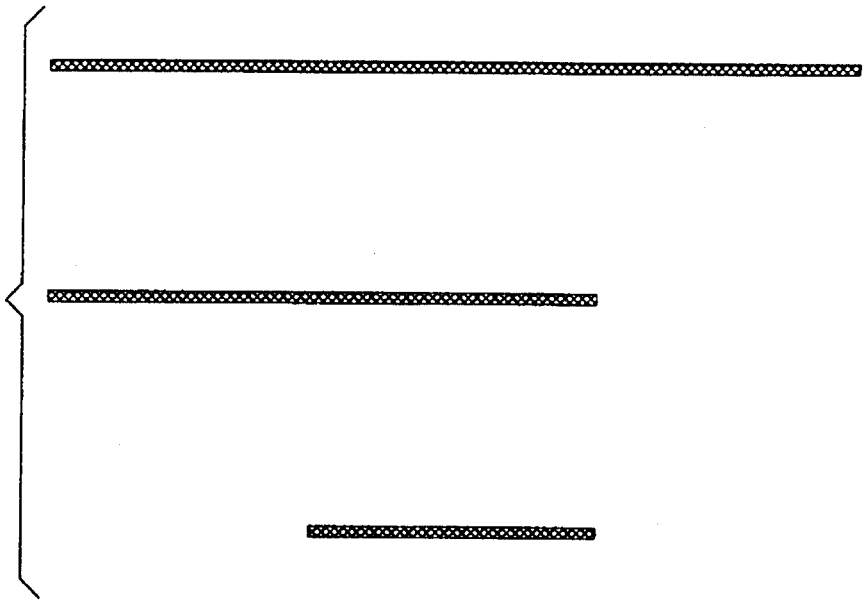
Figure 144:
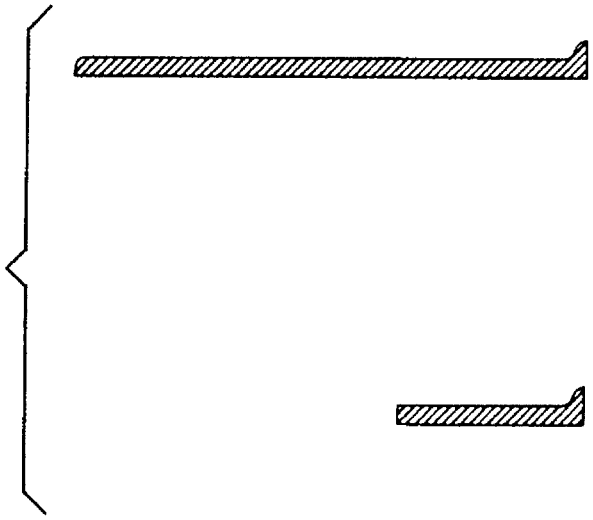
Figure 145:
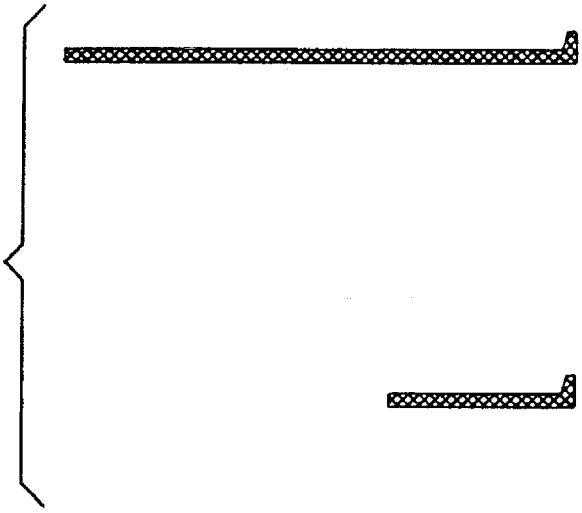
Figure 146:
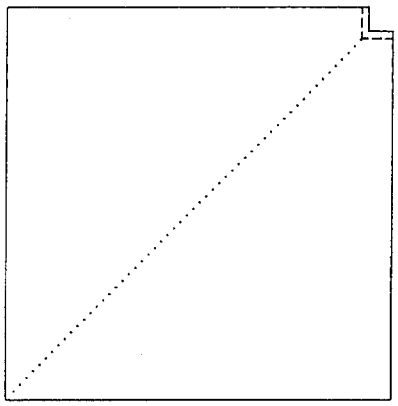
Figure 147:
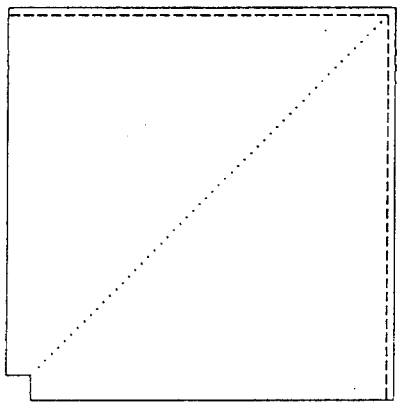
Figure 148:
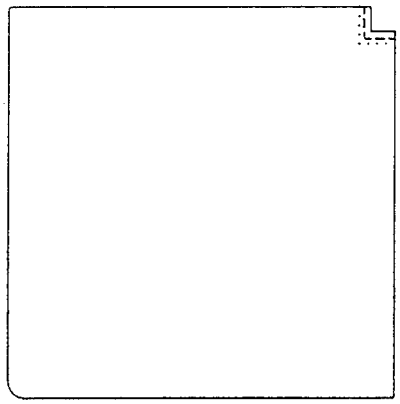
Figure 149:
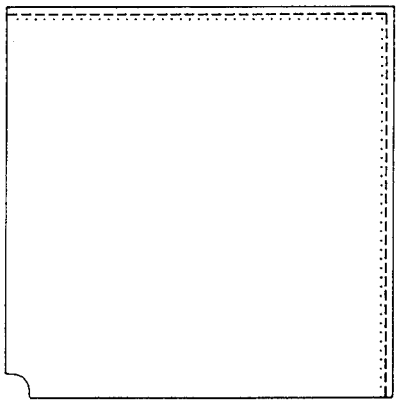
Figure 150:
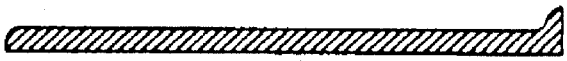
Figure 151:
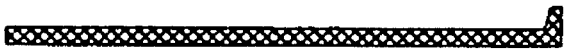
Figure 152:
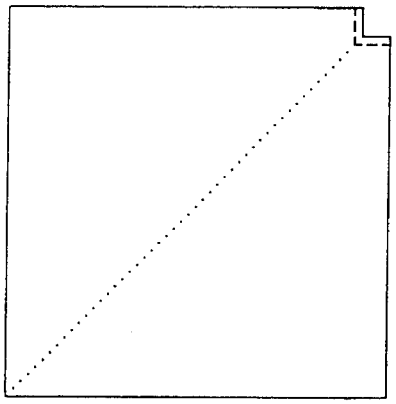
Figure 153:
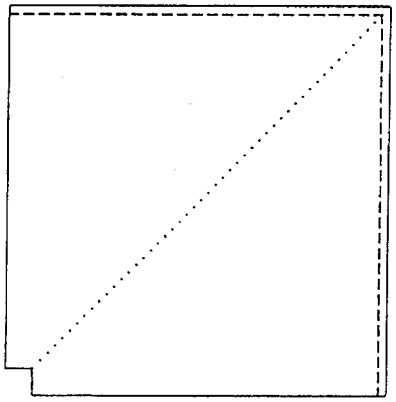
Figure 154:
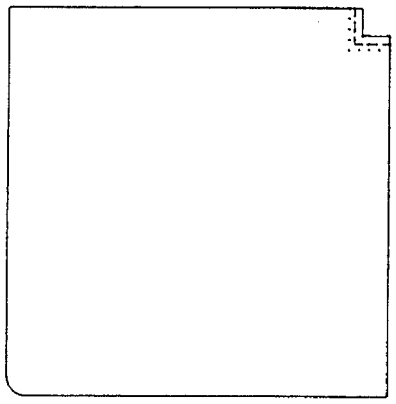
Figure 155:
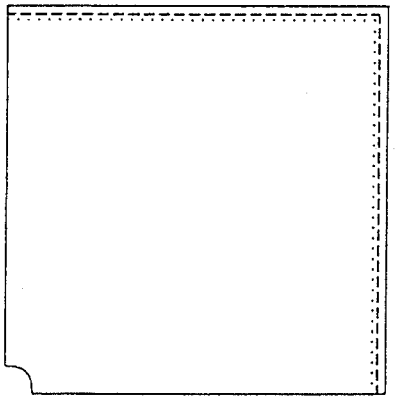
Figure 156:
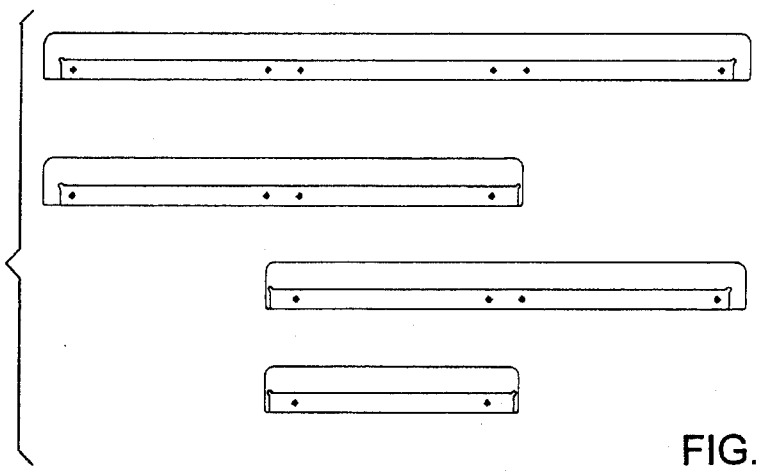
Figure 157:
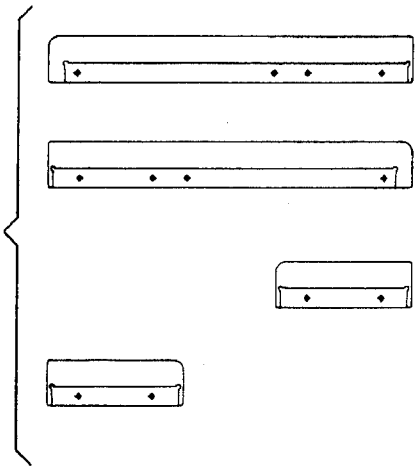
Figure 158:
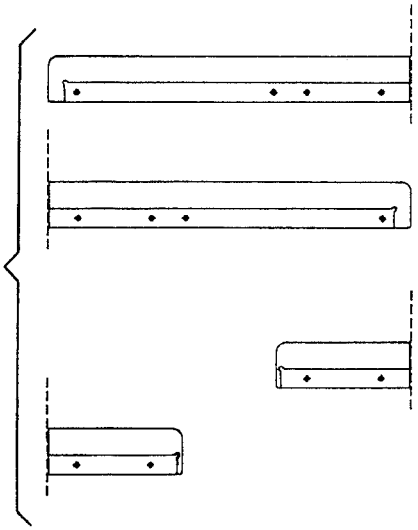
Figure 159:
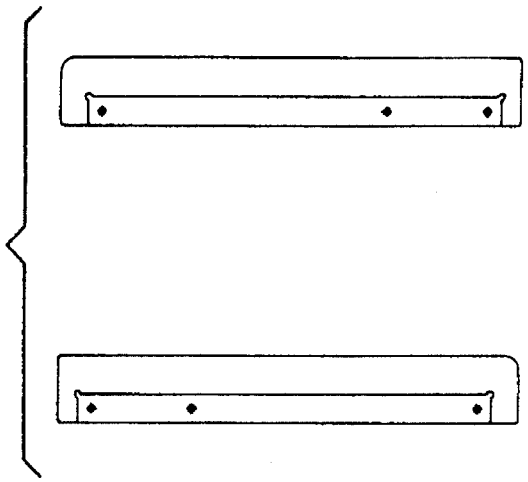
Figure 160:
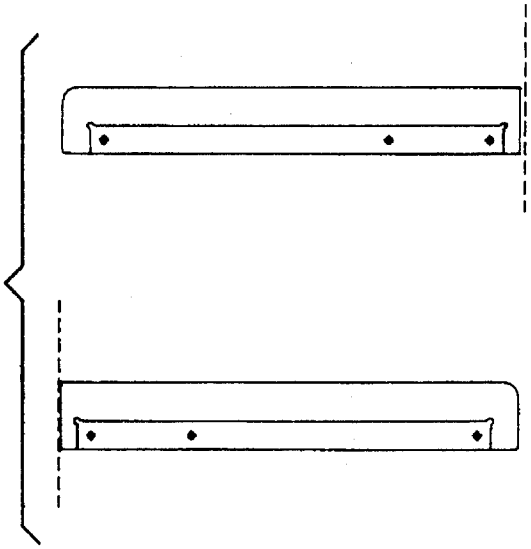
Figure 161:
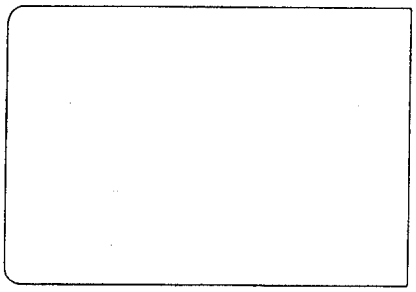
Figure 162:
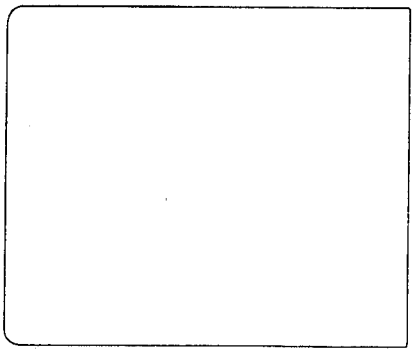
Figure 163:
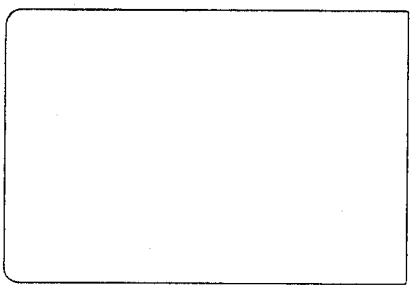
Figure 164:
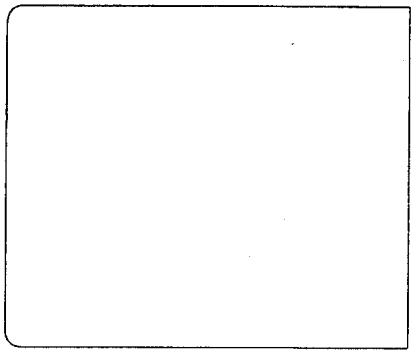
Figure 165:
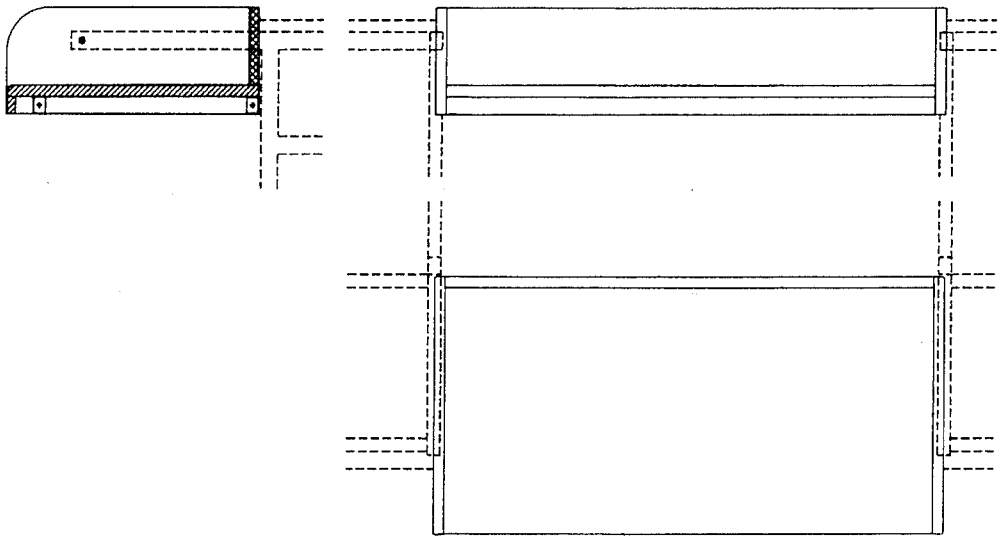
Figure 166:
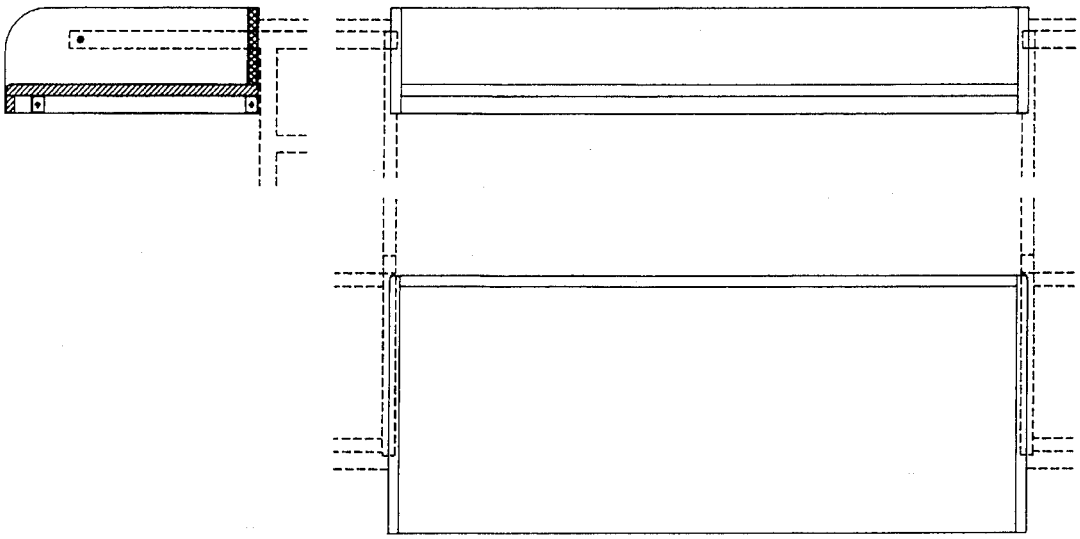
Figure 167:
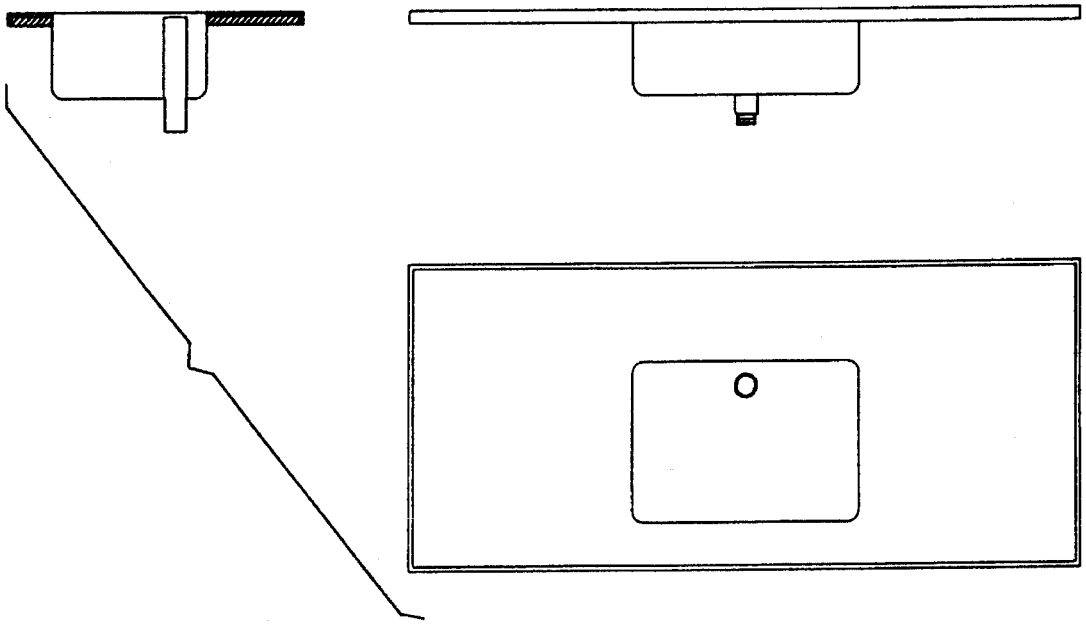
Figure 168:
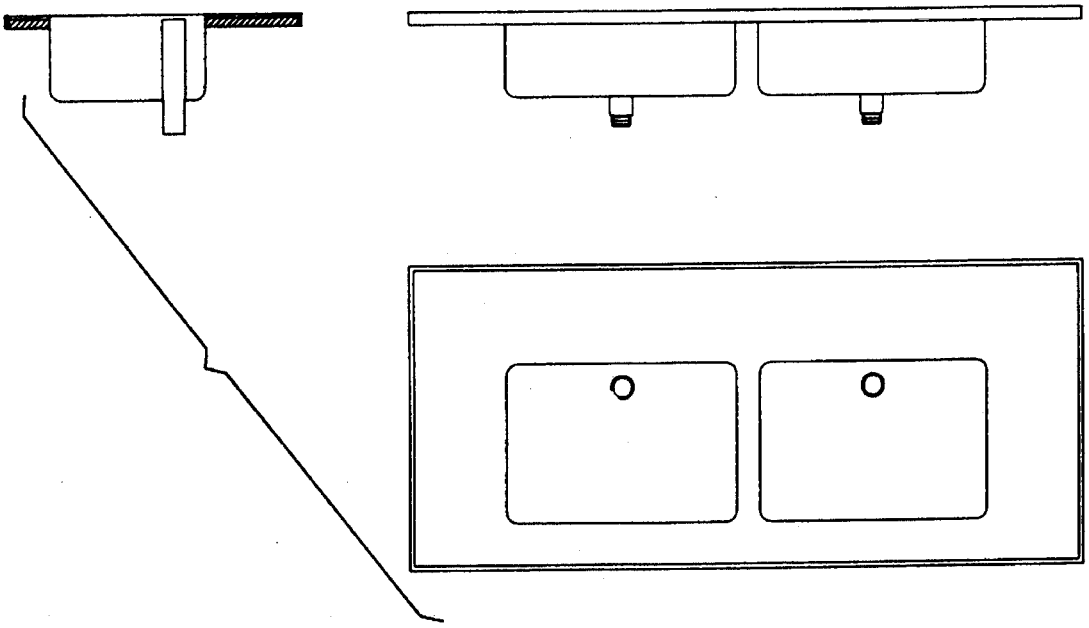
Figure 169:
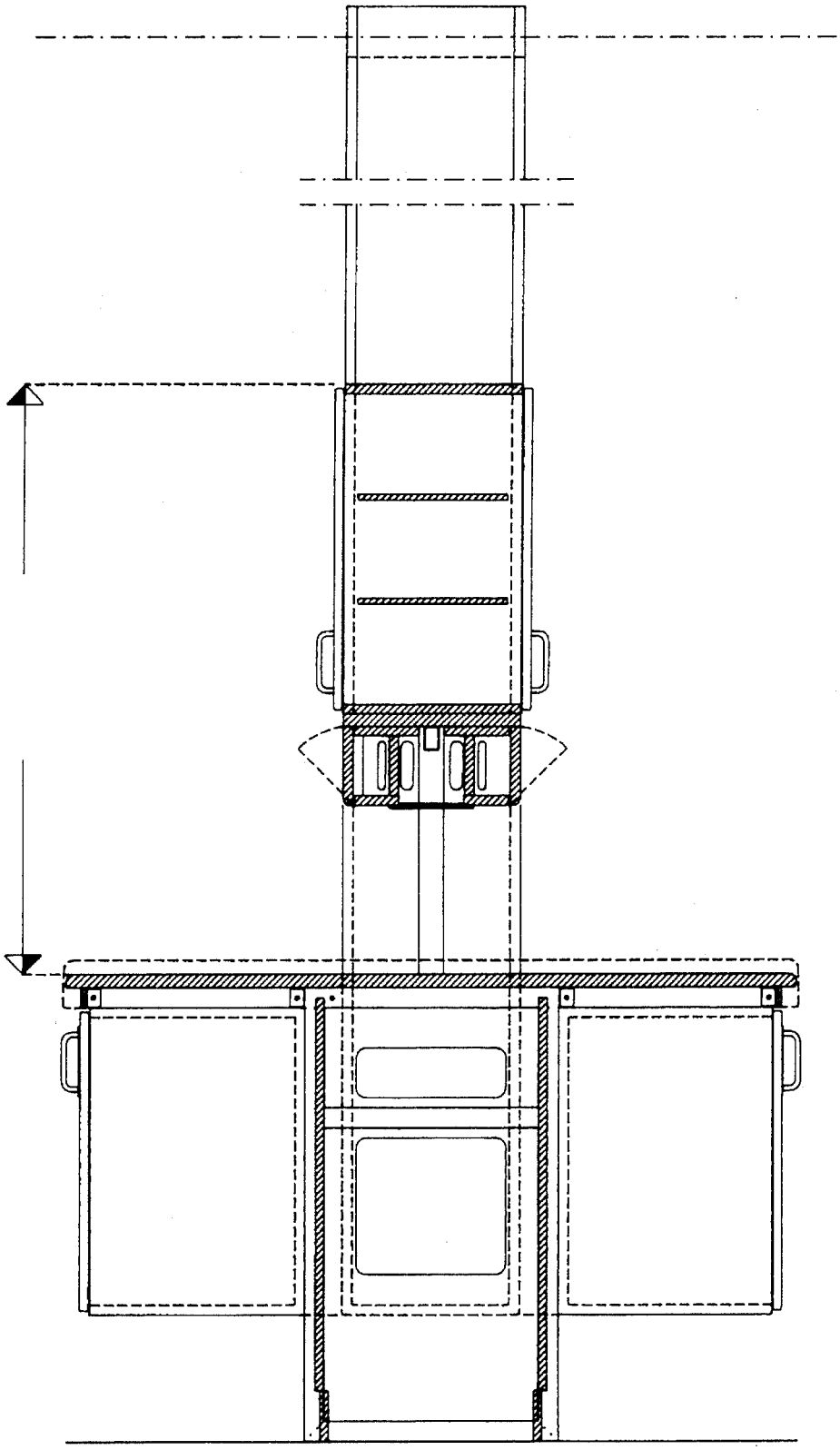
FIGS. 169–187 illustrate different types of tops.
Figure 170:
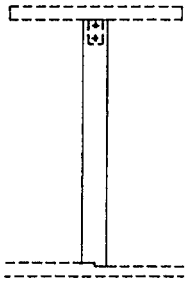
Figure 171:
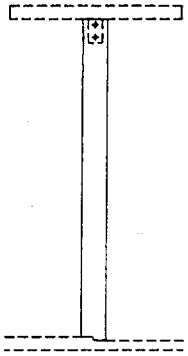
Figure 172:
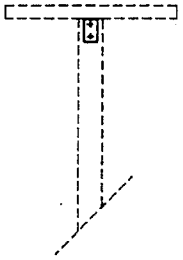
Figure 173:
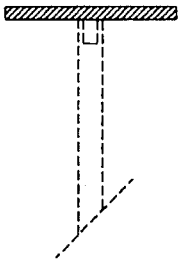
Figure 174:
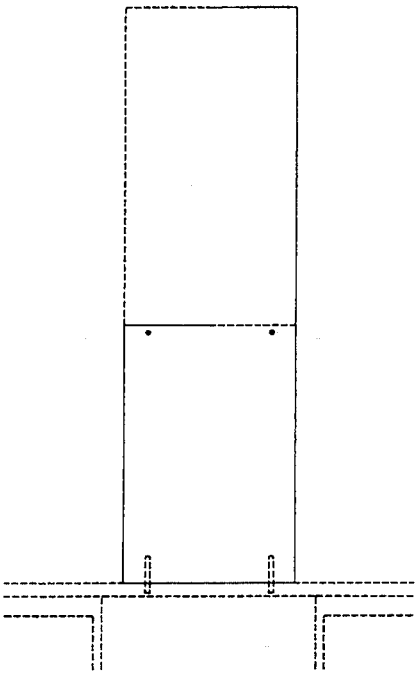
Figure 175:
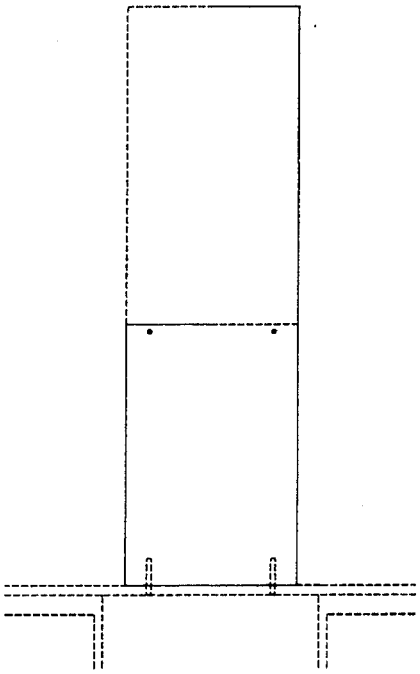
Figure 176:
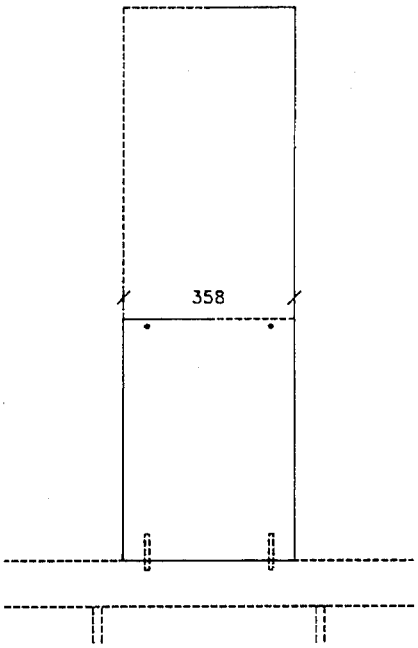
Figure 177:
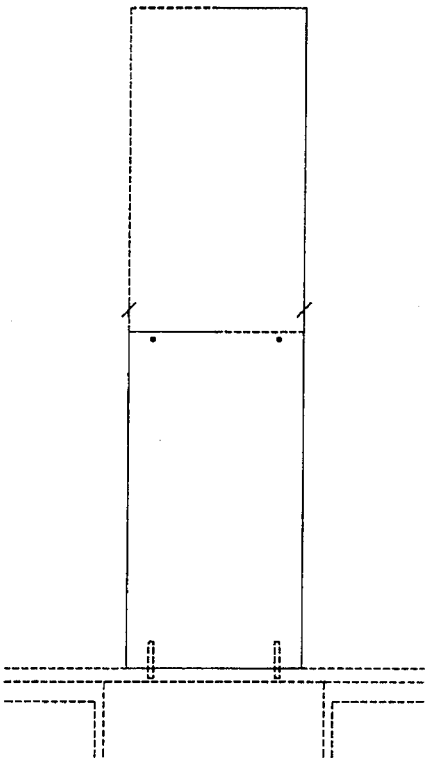
Figure 178:
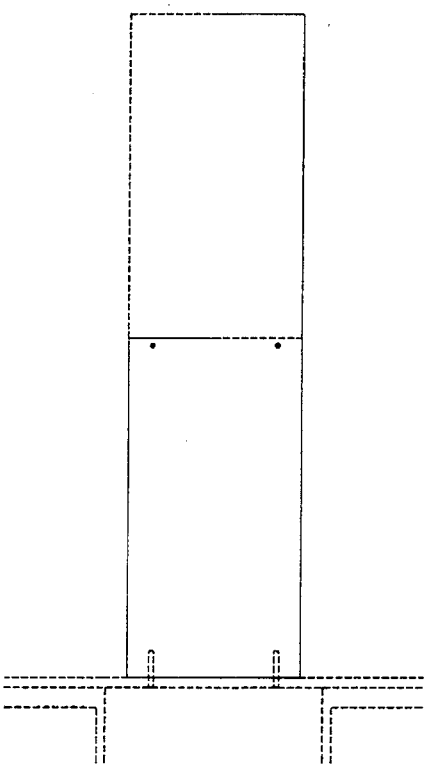
Figure 179:
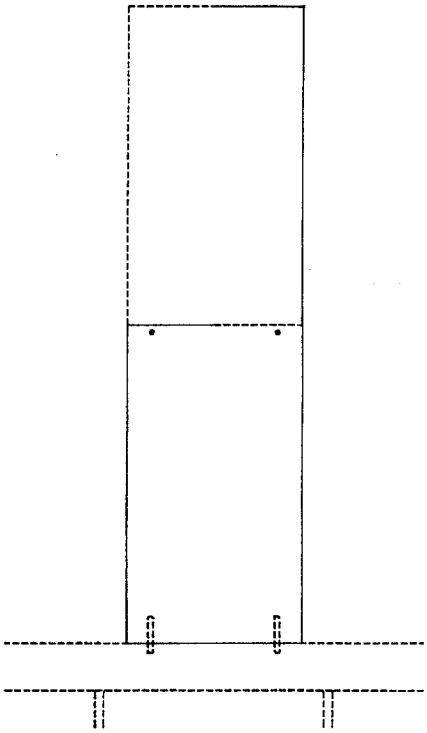
Figure 180:
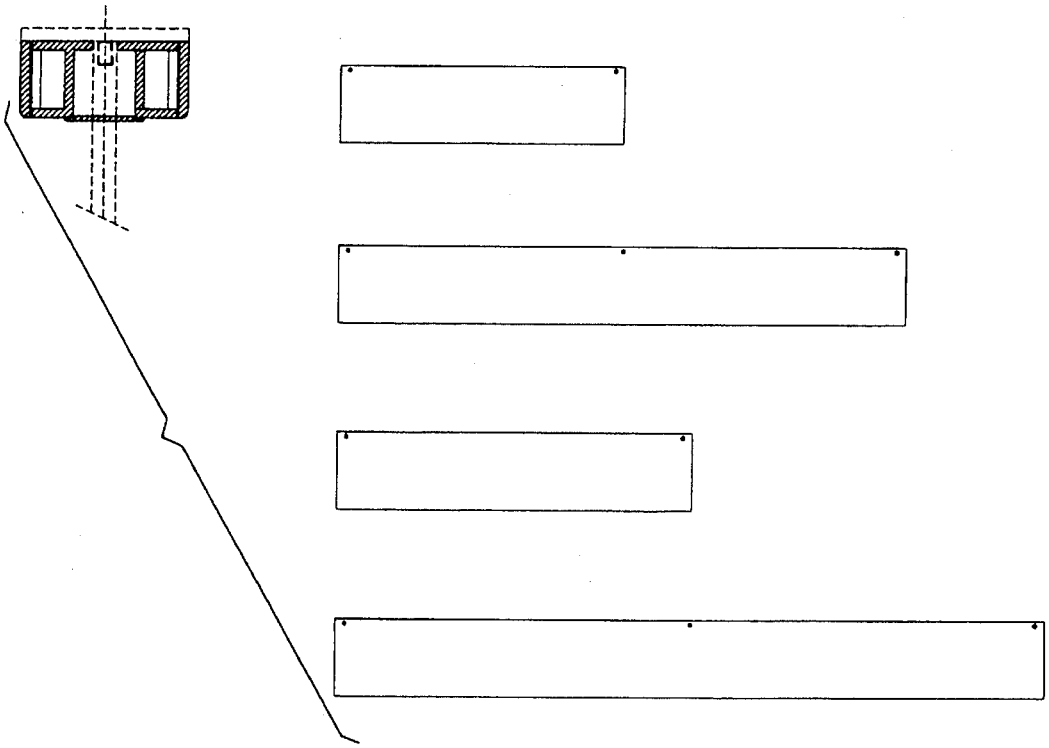
Figure 181:
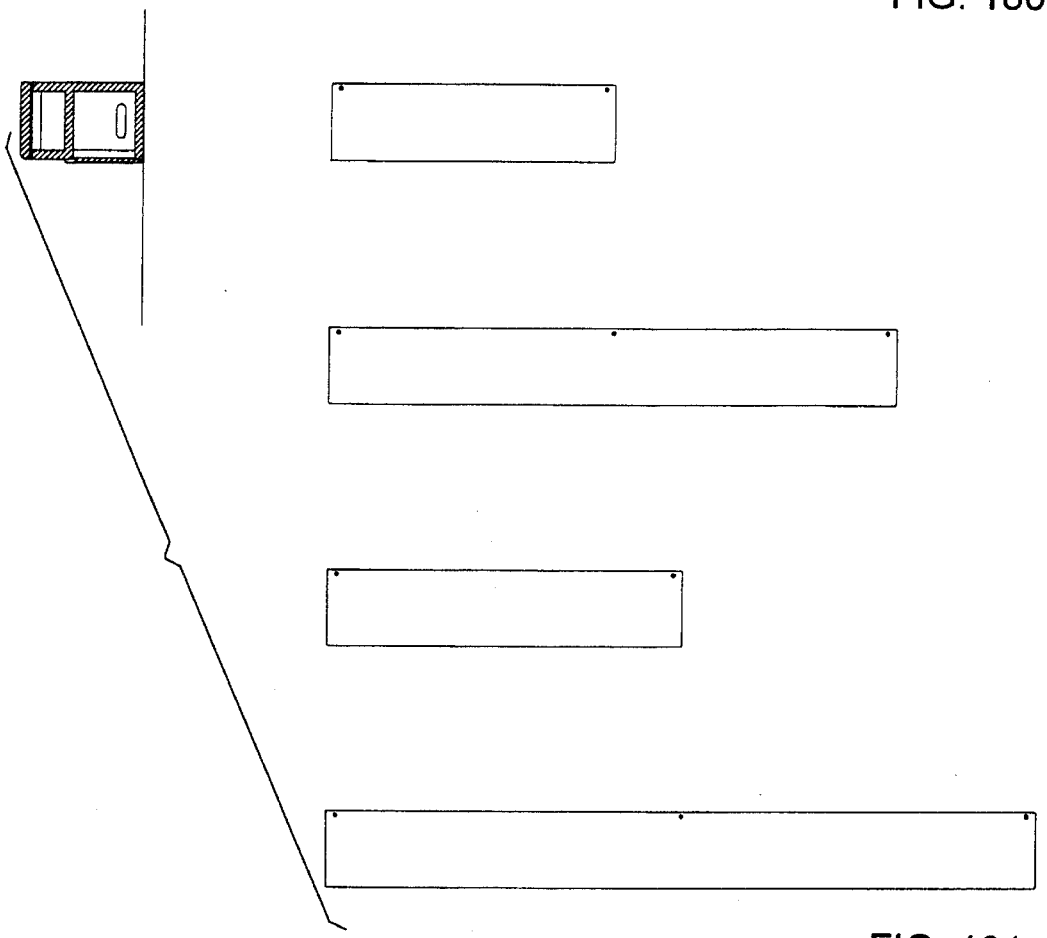
Figure 182:
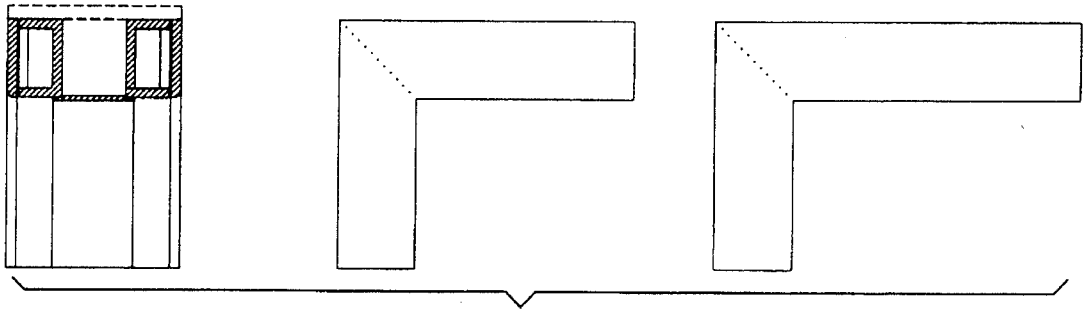
Figure 183:
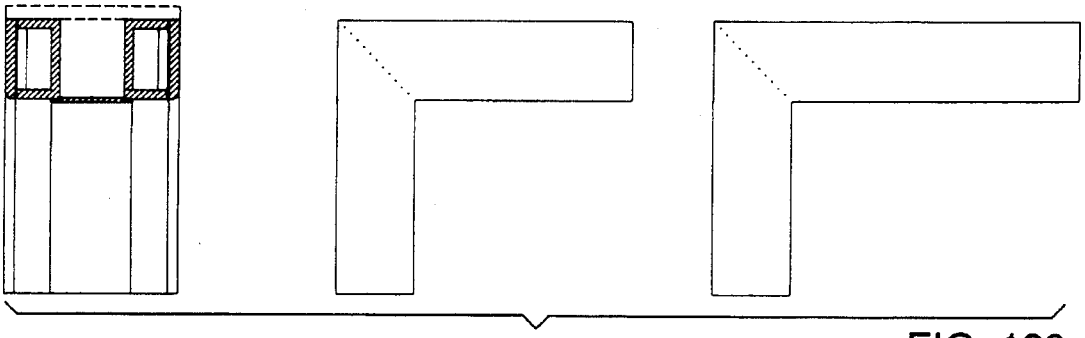
Figure 184:
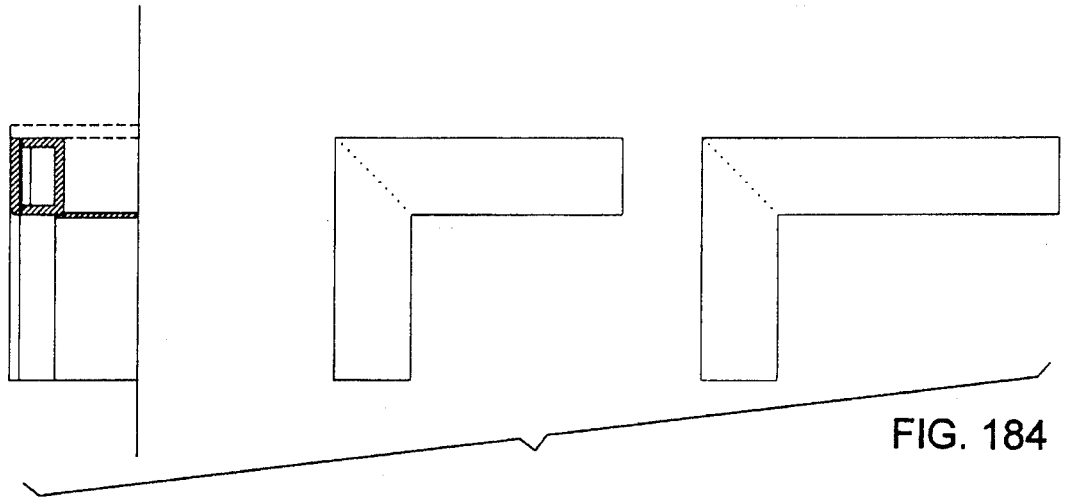
Figure 185:
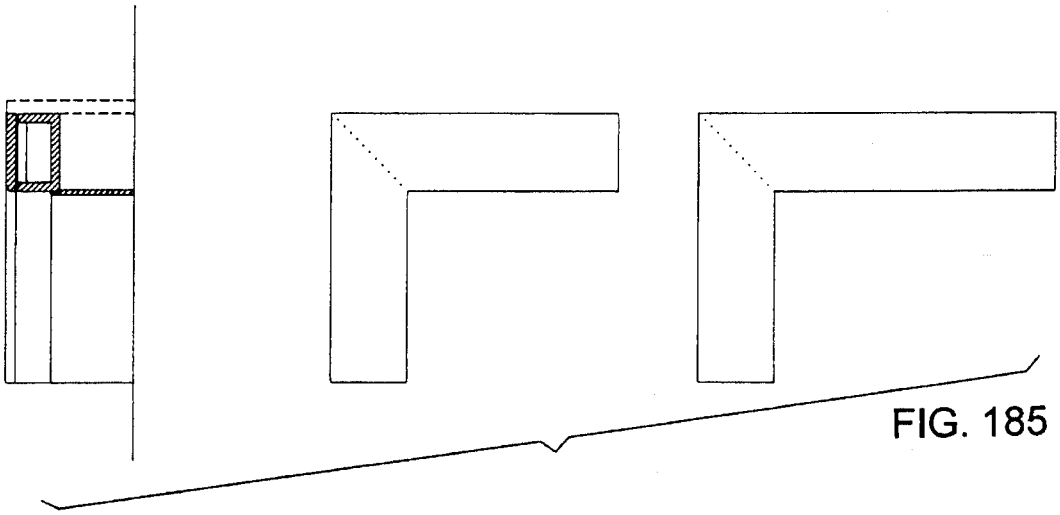
Figure 186:
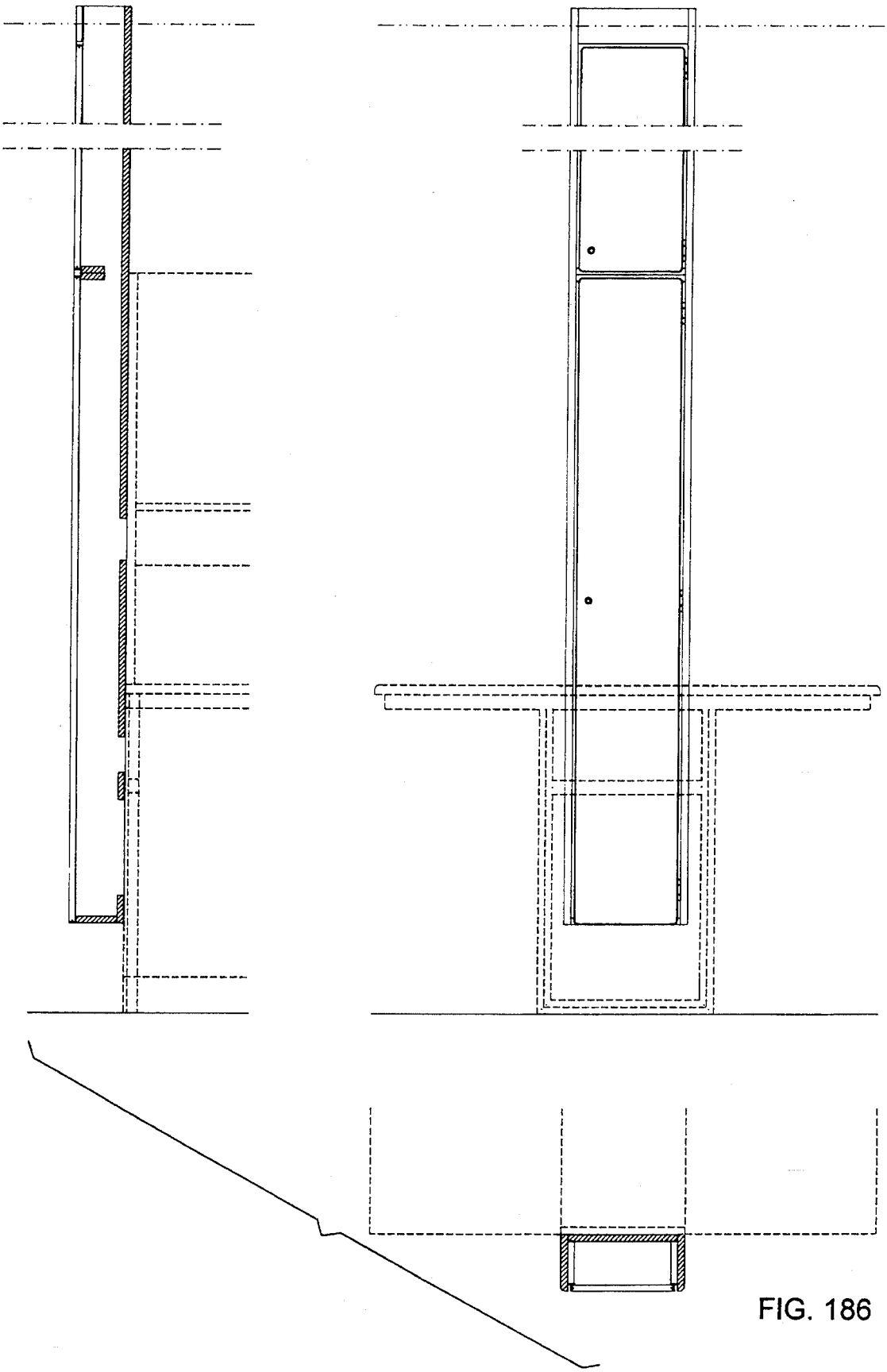
Figure 187:
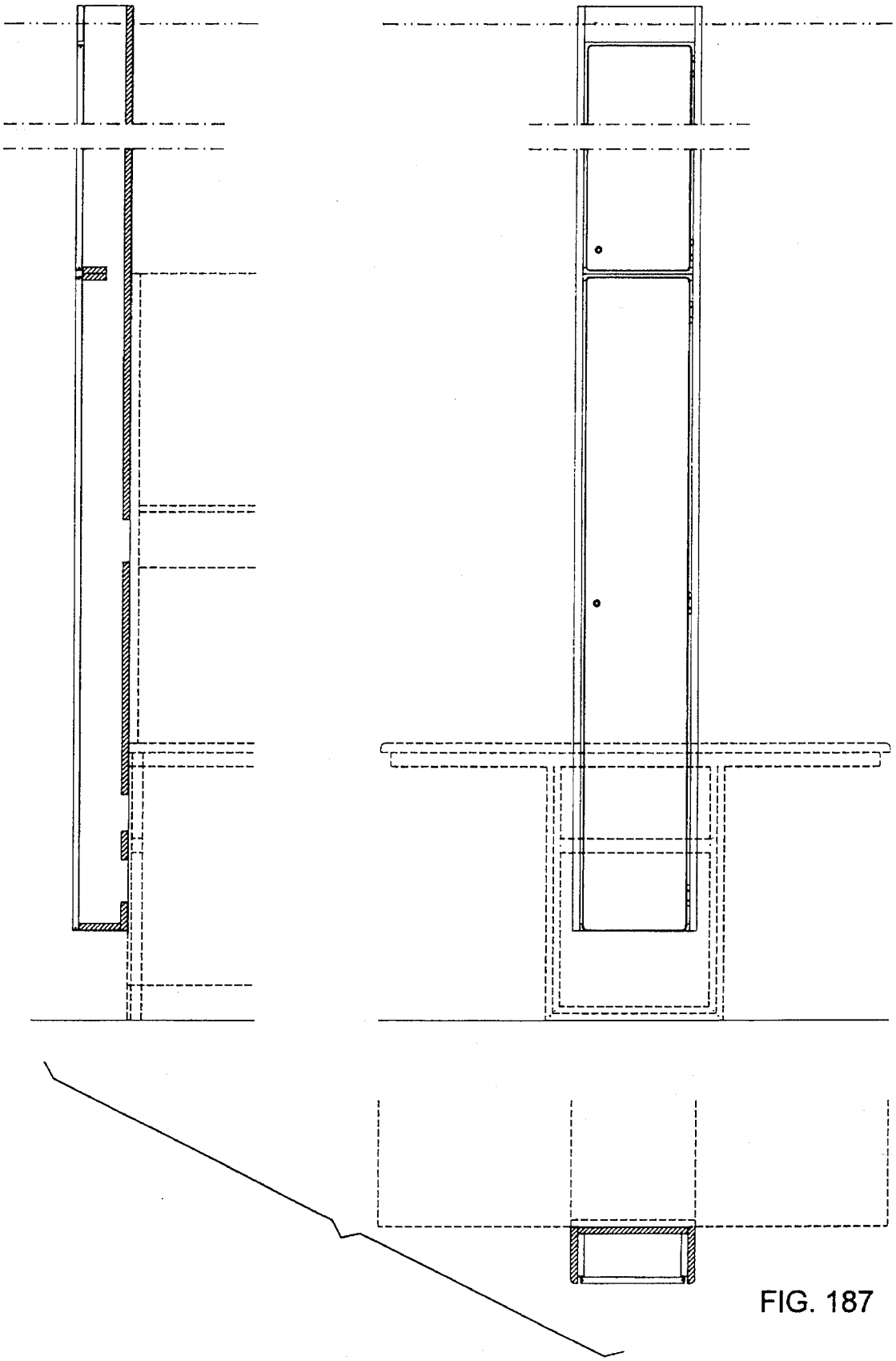
Figure 188:
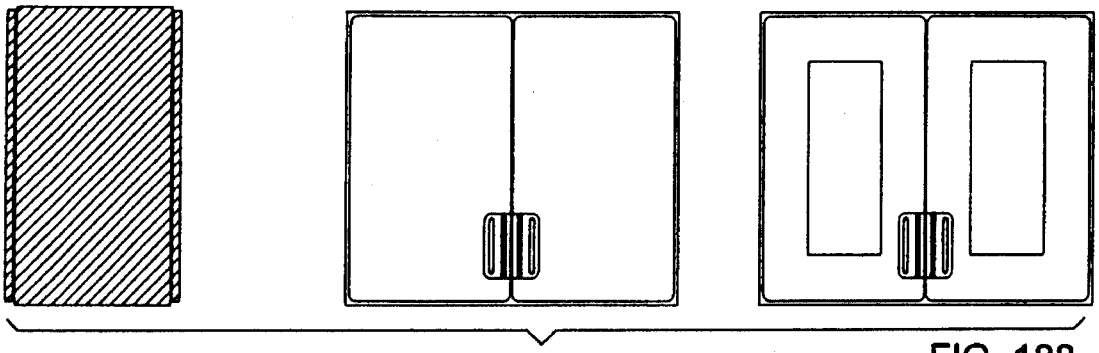
FIGS. 188–224 illustrate different base and top cabinets.
Figure 189:
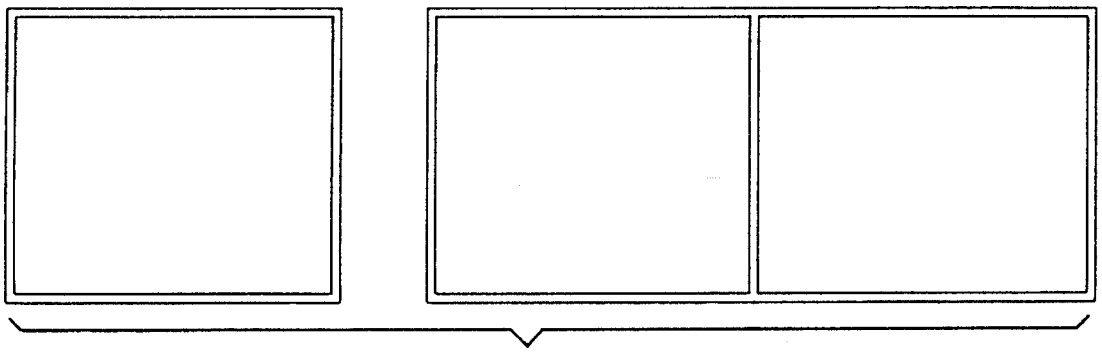
Figure 190:
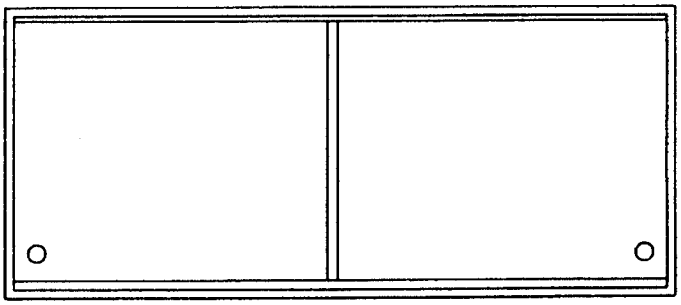
Figure 191:
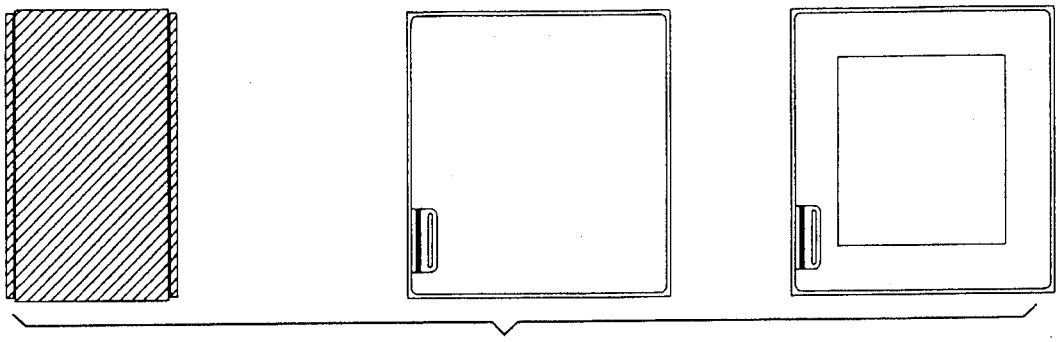
Figure 192:
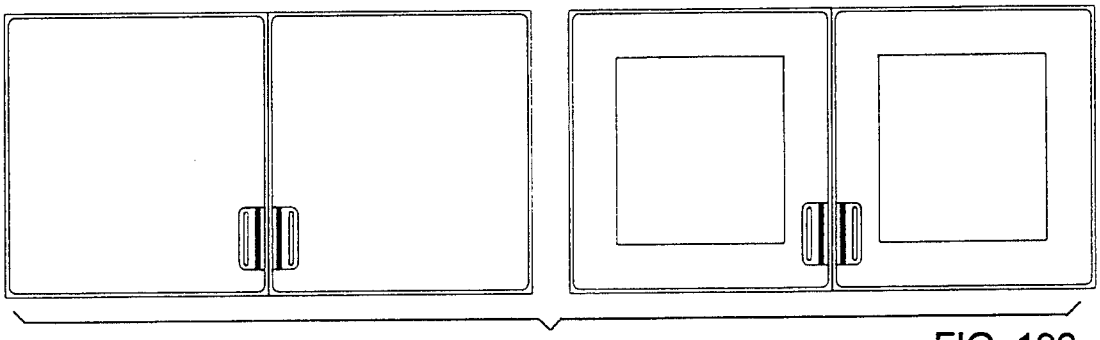
Figure 193:
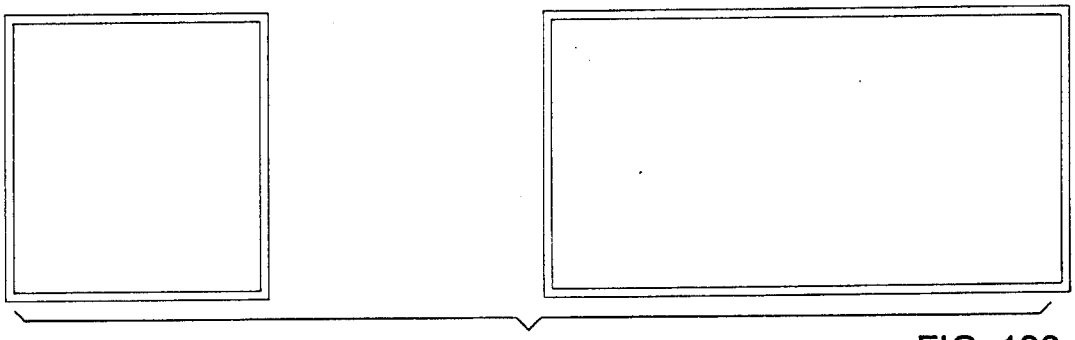
Figure 194:
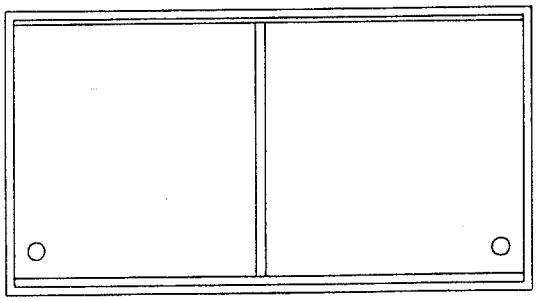
Figure 195:
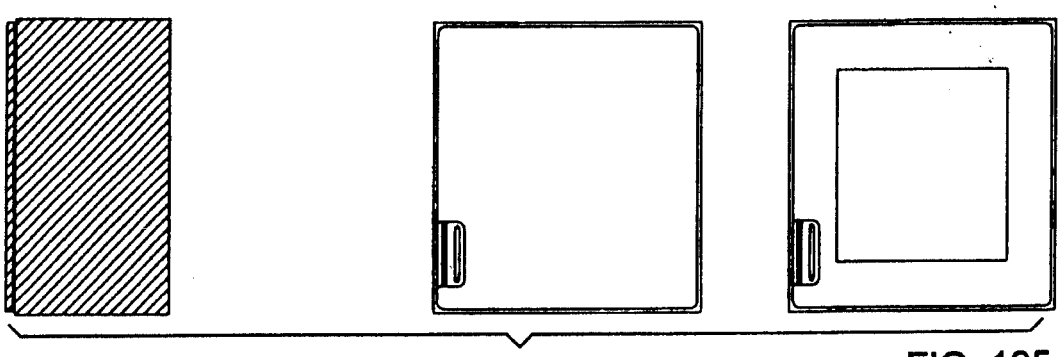
Figure 196:
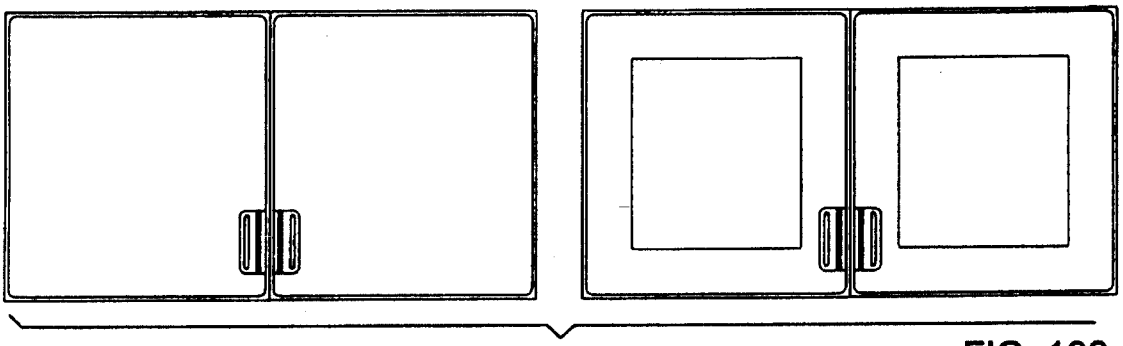
Figure 197:
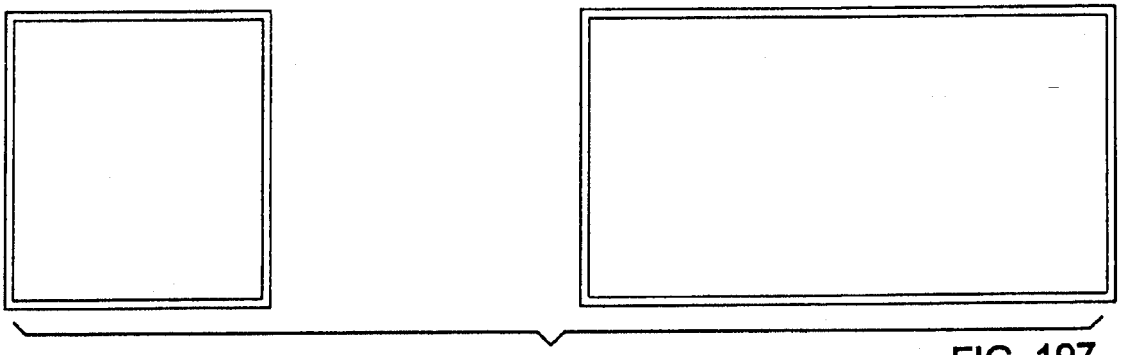
Figure 198:
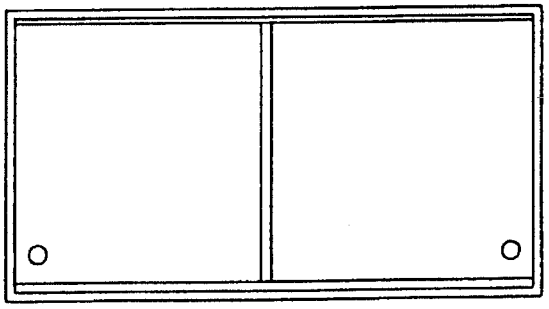
Figure 199:
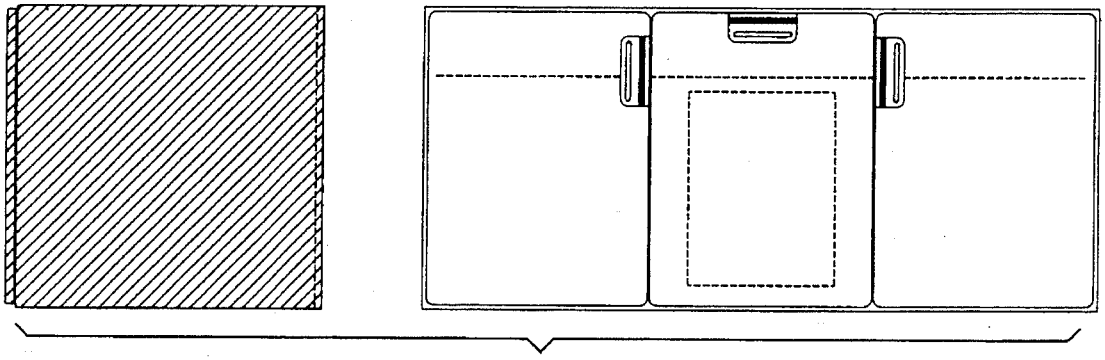
Figure 200:
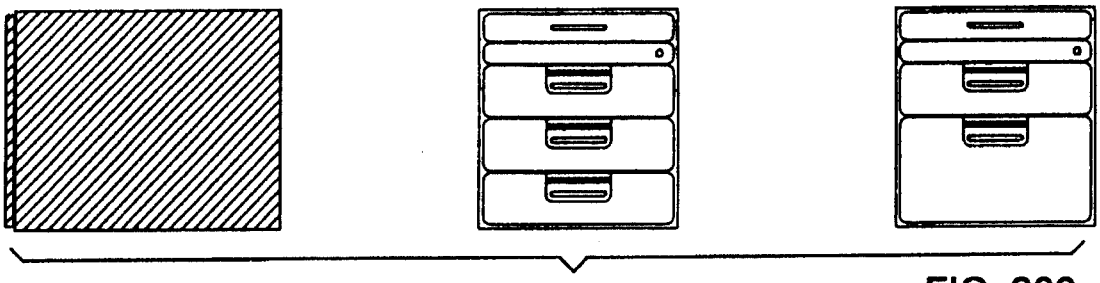
Figure 201:
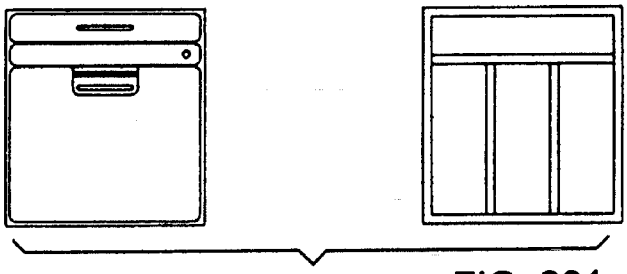
Figure 202:
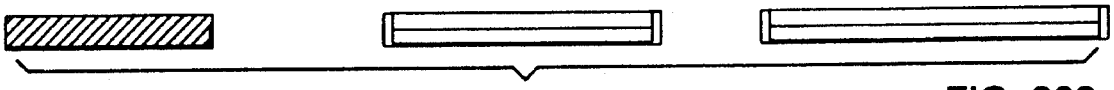
Figure 203:
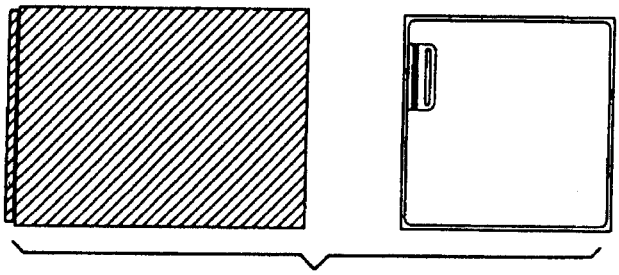
Figure 204:
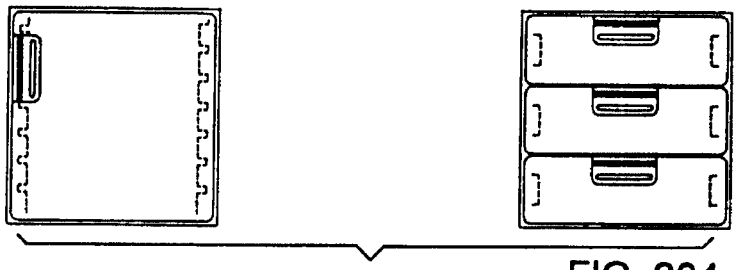
Figure 205:
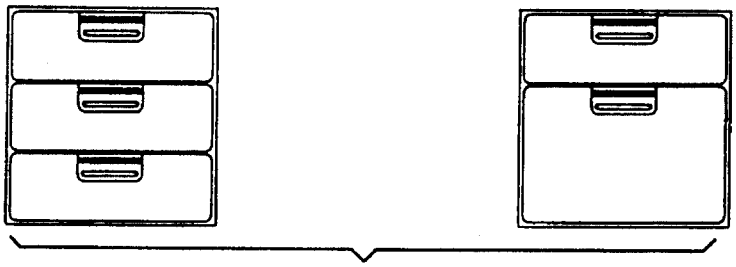
Figure 206:
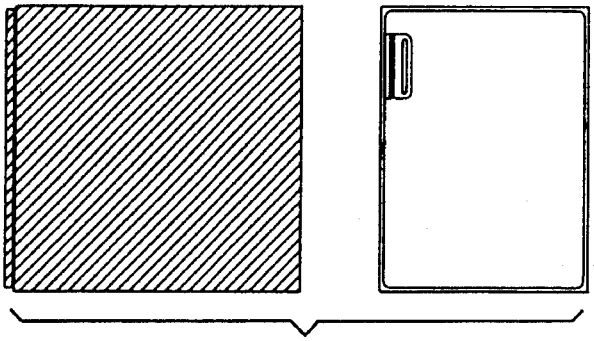
Figure 207:
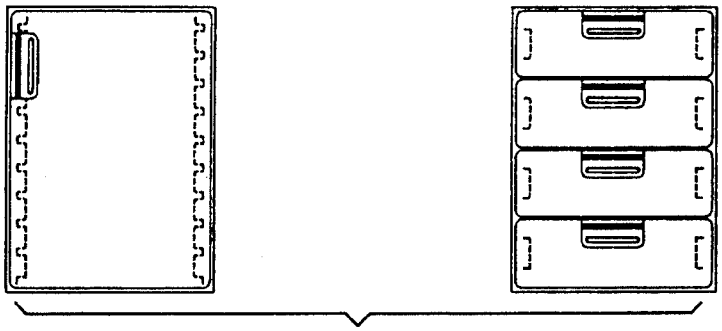
Figure 208:
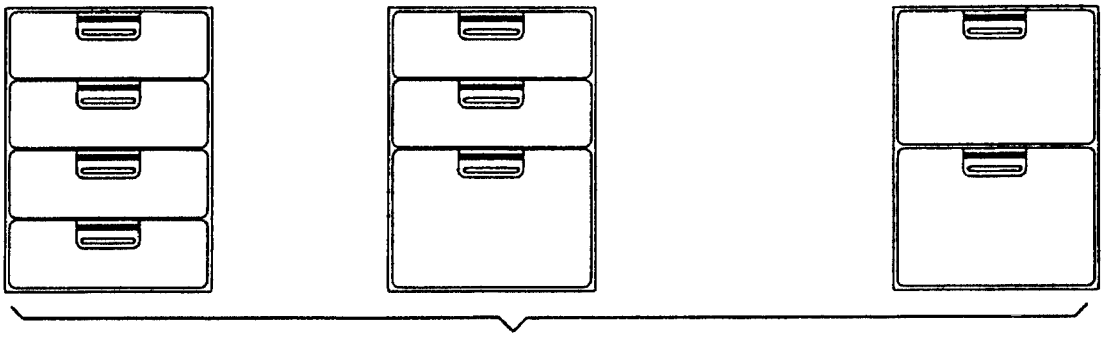
Figure 209:
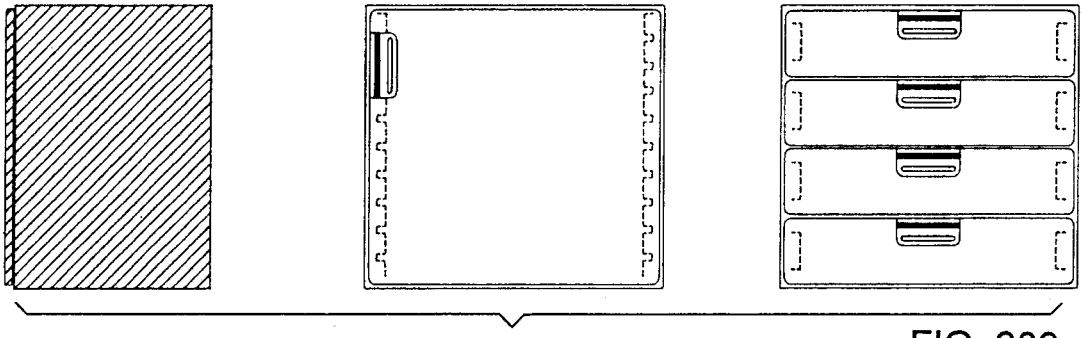
Figure 210:
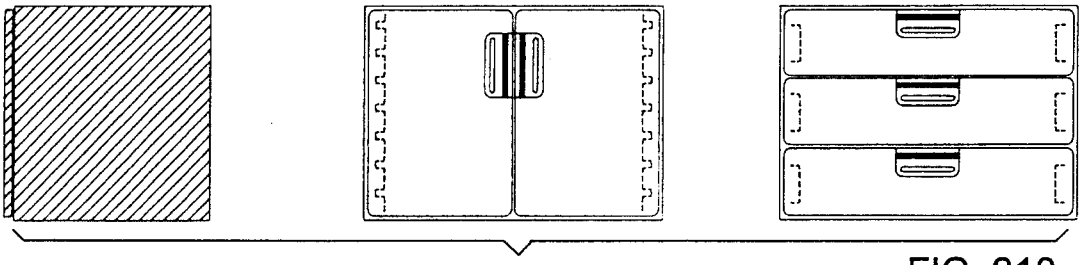
Figure 211:
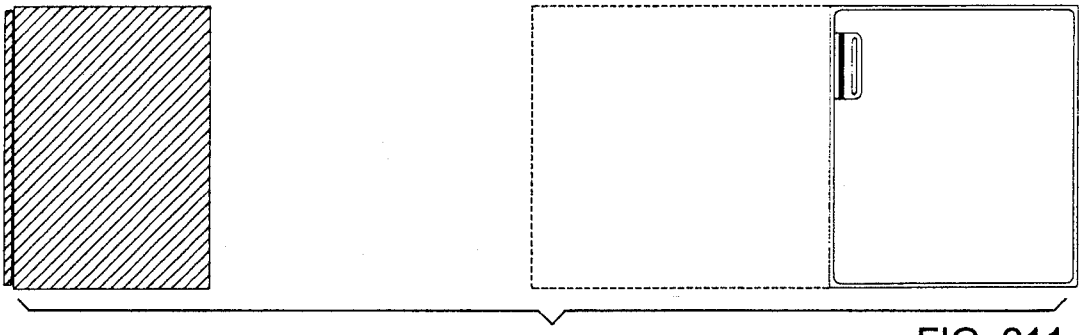
Figure 212:
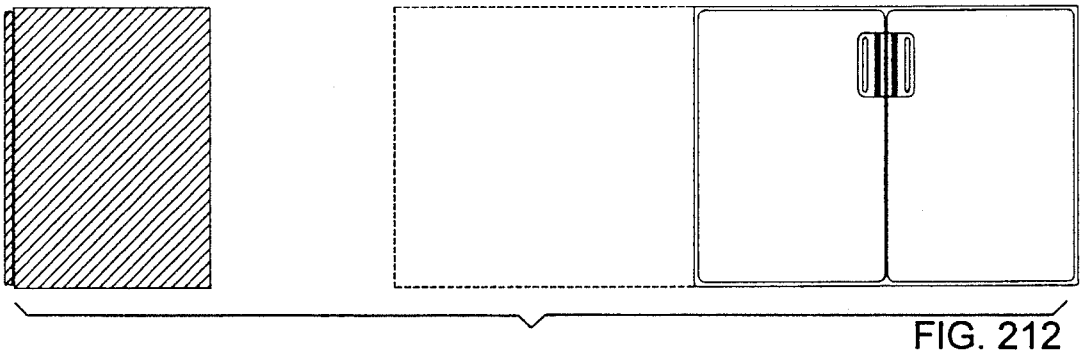
Figure 213:
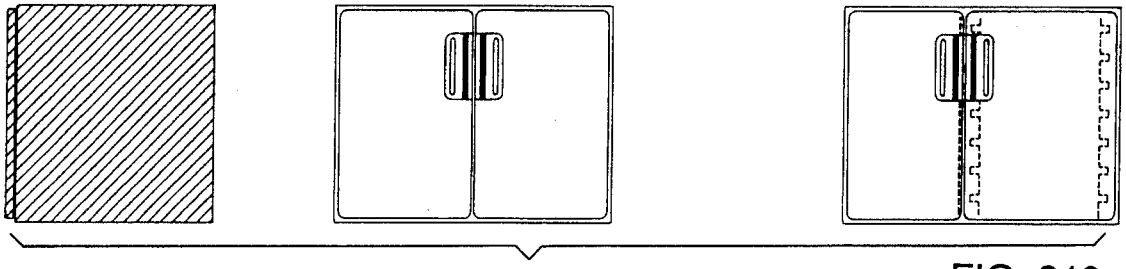
Figure 214:
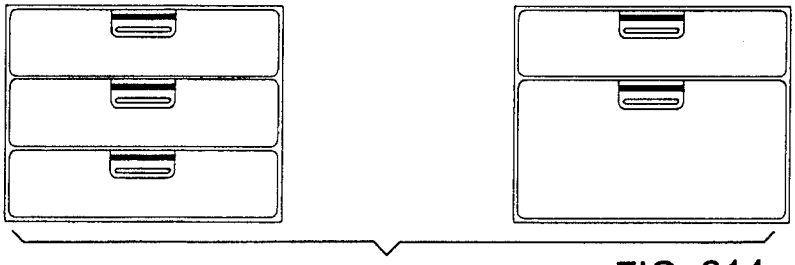
Figure 215:
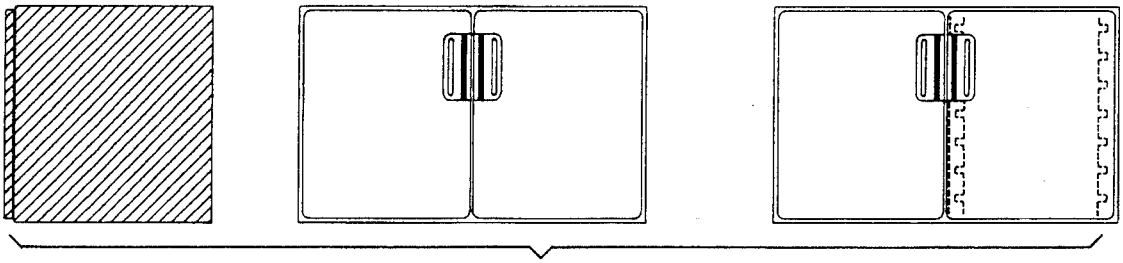
Figure 216:
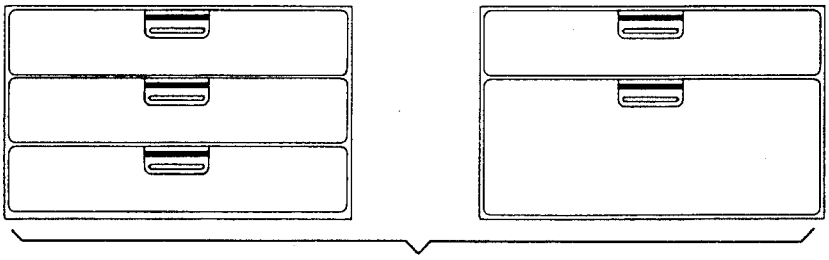
Figure 217:
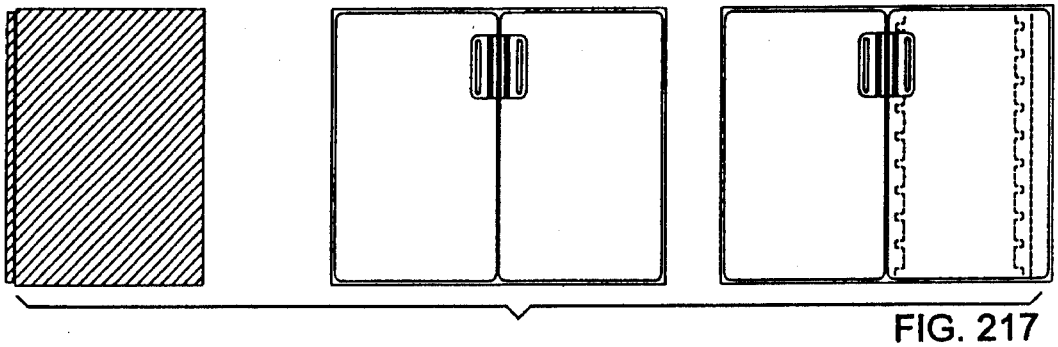
Figure 218:
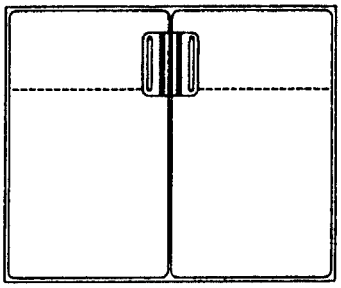
Figure 219:
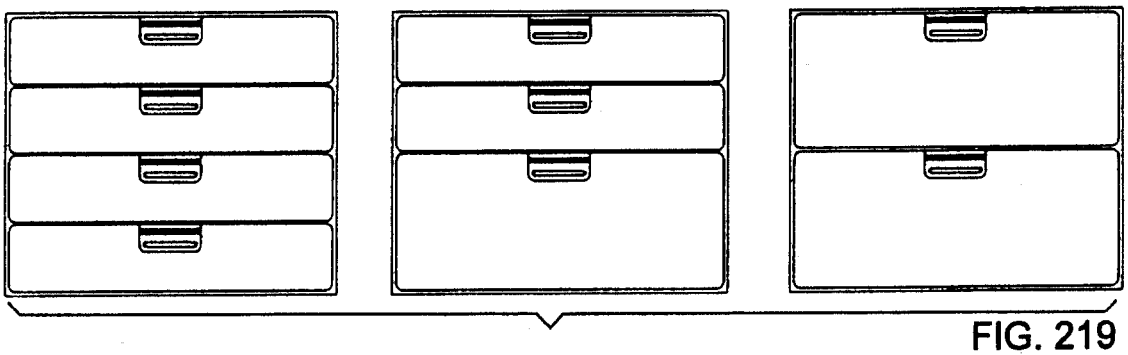
Figure 220:
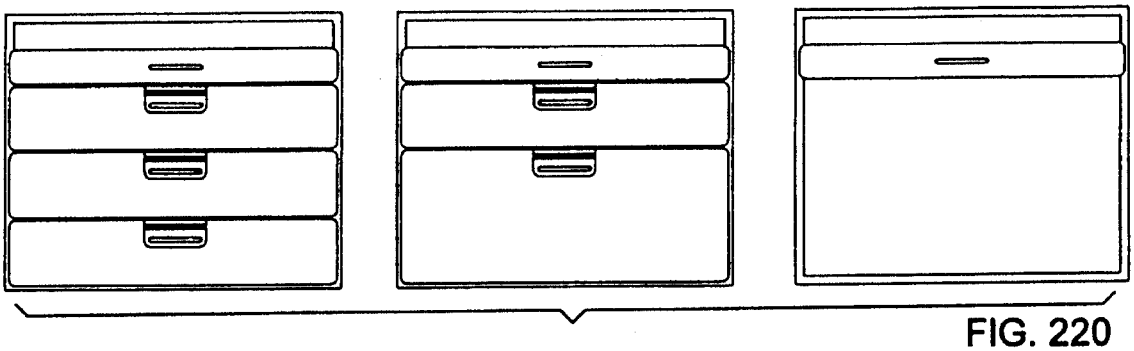
Figure 221:
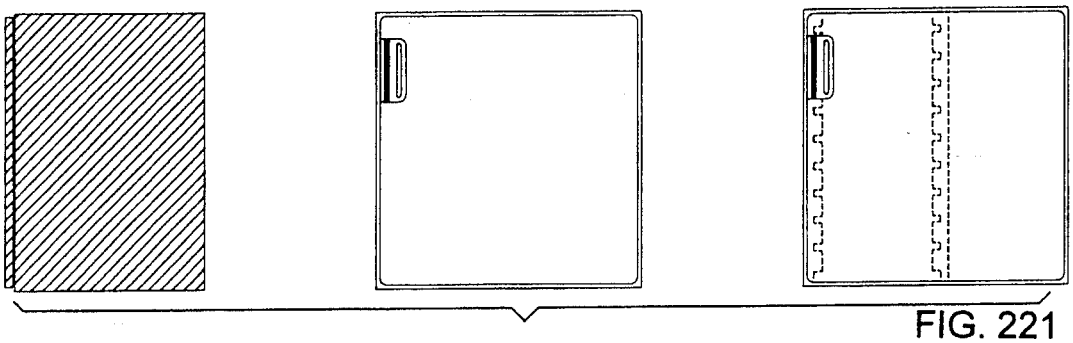
Figure 222:
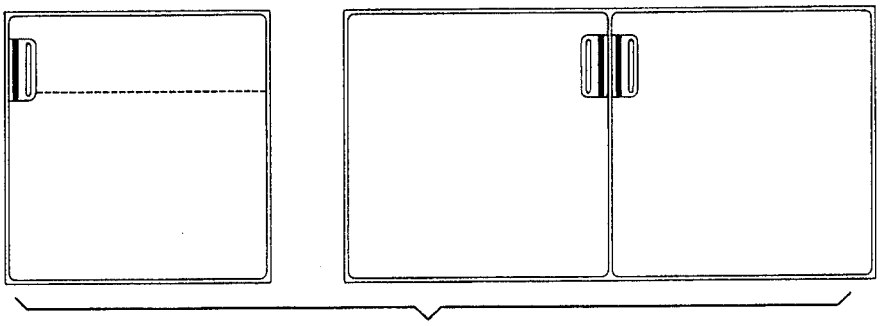
Figure 223:
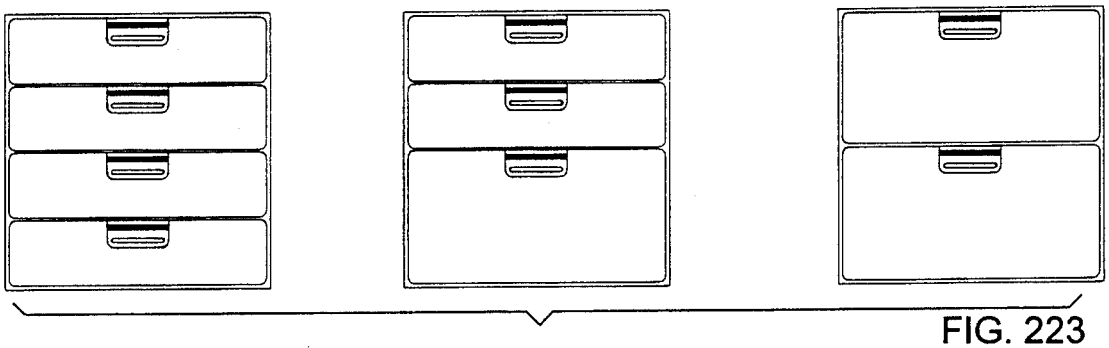
Figure 224:
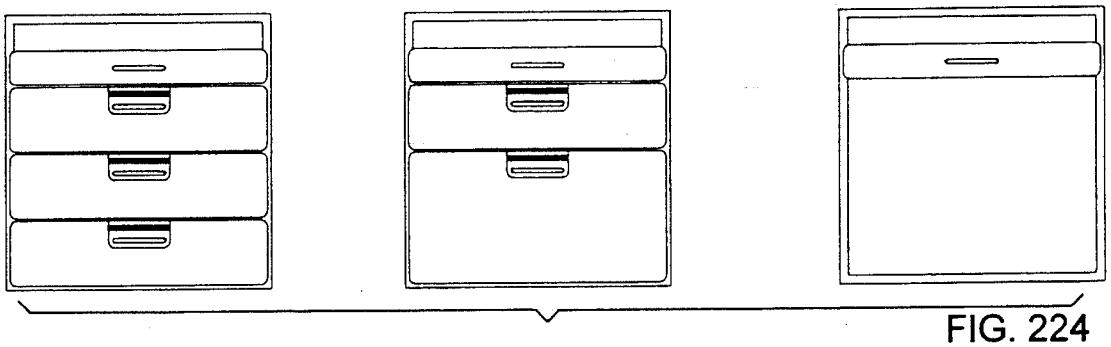

FIGS. 9–10 show how the frame is used in connection with a table top in a corner turning outward and inward, respectively.

FIGS. 15–22 show embodiments wherein the frames are intended to be secured to a wall. The frame 1 of this embodiment consists of a small substantially square element formed by the profiles 2, 3, 4, 5. The frame profile which is most distant from the wall extends beyond the circumference of the frame in order to form a leg which extends to the floor.

The remaining FIGS. 23–65 show further alternative embodiments of systems wherein the frame is used in combinations with different table heights, different table tops, different covering panels and different shelf segments placed on the cross bar.

The set FIGS. 67–80 illustrate frames without covering panels for use in connection with deep base cabinets, corresponding table tops for a corner turning outward and inward, respectively, bracing crosses between the frames, and frames with legs comprising adjustable feet.

FIGS. 81–124 illustrate different kinds and types of covering panels placed on the frame and covering a major or minor part of the frame. The covering panels are either secured to the frame or mounted loosely by means of hooks or the like. Also illustrated are covering panels comprising holes so as to permit the installation of cables for gas, water, electricity, or compressed air or other technical installations between frames which are not accessible from other sides.

The set of D-figures illustrates carrying frames and bottom parts for use under table tops when the system is used in connection with work which implies or may imply particularly heavy loads on the system, both dynamic and static loads, such as heavy wash basins inserted in the table top.

FIGS. 138–168 illustrate table tops in different lengths and in different embodiments, possibly comprising edge lists or finishing profiles along one or more of the edges of the table top, and with the table tops manufactured for different materials such as laminate or compact laminate. Further illustrations show writing modules which offer the possibility of lowering the table top height over a given part of the total extension of the table top. Table tops for inserting or mounting wash basins, fittings or other installations are also illustrated.

FIGS. 169–187 show the frame when used in connection with a combination of base and top cabinets wherein the top cabinets are supported by a support leg which extends between the top of the frame or the table top and the bottom of the top cabinets. Also illustrated is the possibility of providing disposition shelves, cable trays, and technical panels which are placed between the table top and the top cabinets in order to ease the access to them, and end plates for use in connection with the top cabinets. Furthermore, there are illustrations of the technical panels in various dimensions and for various kinds of technical installations, internal cable channels for installing cables, tubes, etc., for the technical panels, external cable channels for the installation of cables, tubes etc. for side panels with holes. The external cable channels may comprise inspection batches or doors.

FIGS. 188–224 various base cabinets, top cabinets and shelves for use in connection with the system according to the invention.

Figure 225:
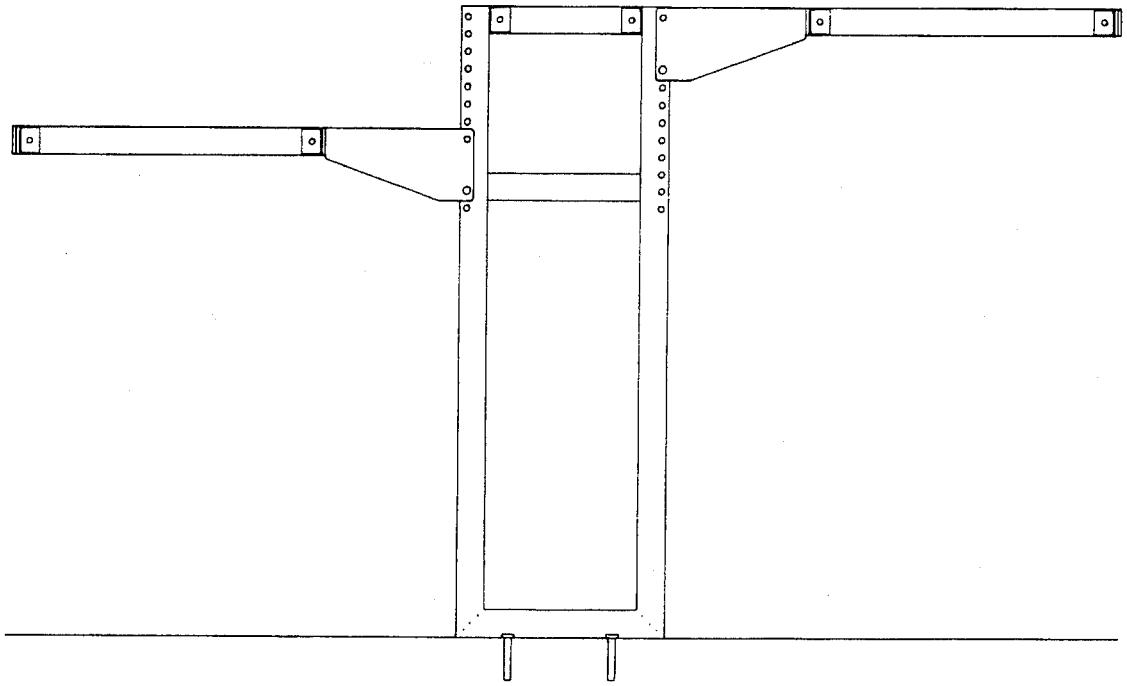
FIG. 225 illustrates a frame with adjustment holes.

FIG. 225 shows that the frame may comprise holes along two vertical profiles in order to permit the adjustment of the height of the elements, such as table tops and base cabinets, which are mounted on support braces secured to the frame by means of bolts or pins.

In the embodiments shown many of the figures state measures in mm. This is not to be seen as a limitation of the system according to the invention, but merely as preferred measures for the individual elements comprised by the system. Further it will be possible to combine the system in many other ways than those shown, and other elements than those shown may be included to form part of the system.

Below is a list of the different elements of the building system according to the invention, as shown in the drawing.

Building modules: 1–8, 11–12, 15–16, 19–20, 23–30, 33–34, 37–38, 41–42, 45–49, 52–53, 56–60, 63–64.

Outward respectively inward turning corner modules: 9–10, 13–14, 17–18, 21–22, 31–32, 35–36, 39–40, 43–44, 50–51, 54–55, 61–62, 65–66.

Carrying frames: 67, 72, 77–80.

Bracing crosses: 70–71–75–76

Outward respectively inward turning corner modules: 68–69, 73–74

Covering panels: 81–116.

Covering panels with external duct channels: 117–124.

Carrying and underframes for wash basins and sidetables: 125–137.

Systematic view in relation to table top dimensions: 138–164.

Writing modules: 165–166.

Wash basin tables: 167–168.

Top cabinets including supporting legs, shelves and covering panels: 169–187.

Top cabinets: 188–198

Base cabinets including doors, drawers and extensionables: 199–224.

Building system with adjustable carrying frames: 225

I claim:

1. A modular building system for building movables consisting of (1) a plurality of frame units, each frame unit comprising four frame members connected together in opposing pairs at right angles, (2) table tops including edge lists, wash basins, gas, electric and air fittings, and writing modules, said table tops being attachable to the frame units, (3) carrying frames for mounting to an underside of a table top, (4) table top modules for providing table top surfaces at differing heights, (5) a plurality of parts attachable to the frame units or the table tops, said parts being selected from the group consisting of cabinet modules, drawer modules, front panels, rear panels, side panels, base panels, supporting legs, cable trays, piping channels and bracing crosses, and (6) means for securing said parts to the frame units or the table tops.

2. A system according to claim 1, wherein the frame units are positionable on or secured to a floor, wherein the four frame members are manufactured from square steel profiles which are joined and secured in rectangles by welding and wherein the joining of said frame members in one end of each frame unit, which is intended for contact with the floor, is made by mitre-joint.

3. A system according to claim 1, wherein each frame unit comprises legs, and including bracing crosses mounted between the frame units.

4. A system according to claim 1, including supporting rails secured to the frame unit which extend in parallel with a plane defined by the frame unit.

5. A system according to claim 1, including supporting rails secured to each frame unit by means of bolts or pins extending through holes in the supporting rails and the frame unit, respectively.

6. A system according to claim 1, wherein the frame unit comprises at least one cross brace extending between two of the frame members.

7. A system according to claim 1, including shelves mounted between the frame units, wherein covering panels and base panels are mounted on the frame units, and wherein at least one of the covering panels includes openings.

8. A system according to claim 1, including an upwardly oriented supporting leg attached to one end of a frame unit, another end being secured wherein said system comprises cable trays and other technical installations, and wherein said installations are placed between the table top and the top cabinets.

9. A modular building system for building movables consisting of (1) a plurality of frame units, each frame unit comprising four frame members connected together in opposing pairs at right angles, at least one of said frame members including a plurality of vertically spaced holes, (2) supporting rails attachable to said holes at a desired height, (3) a plurality of parts attachable to the supporting rails, said parts being selected from the group consisting of table tops, cabinet modules, drawer modules, front panels, rear panels, side panels, base panels, carrying frames, supporting legs, cable trays, piping channels and bracing crosses, and (4)

screw means for securing said parts to the supporting rails at an adjustable slope.

10. A system according to claim 9, wherein the frame units are positionable on or secured to a floor, wherein the four frame members are manufactured from square steel profiles which are joined and secured in rectangles by welding and wherein the joining of said frame members in one end of each frame unit, which is intended for contact with the floor, is made by mitre-joint.

11. A system according to claim 9, wherein each frame unit comprises legs, and including bracing crosses mounted between the frame units.

12. A system according to claim 9, including supporting rails secured to the frame unit which extend in parallel with a plane defined by the frame unit.

13. A system according to claim 9, including supporting rails secured to each frame unit by means of bolts or pins extending through holes in the supporting rails and the frame unit, respectively.

14. A system according to claim 9, wherein the frame unit comprises at least one cross brace extending between two of the frame members.

15. A system according to claim 9, including shelves mounted between the frame units, wherein covering panels and base panels are mounted on the frame units, and wherein at least one of the covering panels including openings.

16. A system according to claim 9, including an upwardly oriented supporting leg attached to one end of a frame unit, another end being secured to supporting rails intended for supporting top cabinets, wherein said system comprises cable trays and other technical installations, and wherein said installations are placed between the table top and the top cabinets.

* * * * *